US008942989B2

(12) United States Patent
Liu et al.

(10) Patent No.: US 8,942,989 B2
(45) Date of Patent: Jan. 27, 2015

(54) SPEECH CODING OF PRINCIPAL-COMPONENT CHANNELS FOR DELETING REDUNDANT INTER-CHANNEL PARAMETERS

(75) Inventors: Zongxian Liu, Singapore (SG); Kok Seng Chong, Singapore (SG)

(73) Assignee: Panasonic Intellectual Property Corporation of America, Torrance, CA (US)

( * ) Notice: Subject to any disclaimer, the term of this patent is extended or adjusted under 35 U.S.C. 154(b) by 335 days.

(21) Appl. No.: 13/518,537

(22) PCT Filed: Dec. 27, 2010

(86) PCT No.: PCT/JP2010/007553

§ 371 (c)(1),
(2), (4) Date: Jun. 22, 2012

(87) PCT Pub. No.: WO2011/080916

PCT Pub. Date: Jul. 7, 2011

(65) Prior Publication Data

US 2012/0259622 A1 Oct. 11, 2012

(30) Foreign Application Priority Data

Dec. 28, 2009 (JP) ..... 2009-298321

(51) Int. Cl.
*G10L 19/008* (2013.01)
*G10L 19/02* (2013.01)

(52) U.S. Cl.
CPC ..... *G10L 19/008* (2013.01); *G10L 19/0204* (2013.01)
USPC ..... 704/501; 704/203; 704/205; 381/2

(58) Field of Classification Search
CPC ..... G10L 19/002; G10L 19/008; G10L 19/02; G10L 19/0204
USPC ..... 704/200.1, 203, 205, 220, 229, 500, 704/501; 381/2, 20, 23
See application file for complete search history.

(56) References Cited

U.S. PATENT DOCUMENTS 4,703,480 A * 10/1987 Westall et al. ..... 704/212
6,138,101 A * 10/2000 Fujii ..... 704/500

(Continued)

FOREIGN PATENT DOCUMENTS

WO 03/085645 10/2003
WO 2005/098825 10/2005

(Continued)

OTHER PUBLICATIONS

Hendrik Fuchs, "Improving Joint Stereo Audio Coding by Adaptive Inter-channel Prediction", Proc. of IEEE ASSP Workshop on Applications of Signal Processing to Audio and Acoustics, New Paltz, NY, USA, Oct. 17-20, 1993, PP.

(Continued)

*Primary Examiner* — Martin Lerner
(74) *Attorney, Agent, or Firm* — Greenblum & Bernstein, P.L.C.

(57) ABSTRACT

Disclosed is an audio encoding device which removes unnecessary inter-channel parameters from the subject to be encoded, improving the encoding efficiency thereby. In this audio encoding device, a principal component analysis unit (301) converts an inputted left signal $\{L_{sb}(f)\}$ and an inputted right signal $\{R_{sb}(f)\}$ into a principal component signal $\{PC_{sb}(f)\}$ and an ambient signal $\{A_{sb}(f)\}$ and calculates for each sub-band, a rotation angle which indicates the degree of conversion; a monophonic encoding unit (303) encodes the principal component signal $\{Pc_{sb}(f)\}$; a rotation angle encoding unit (302) encodes the angle of rotation $\{\theta_b\}$; a local monophonic decoding unit (603) creates a decoded principal component signal; and a redundant parameter elimination unit (604) identifies the redundant parameters by analyzing the encoding quality of the decoded principal component signal and eliminates the redundant parameters from the signal to be encoded.

5 Claims, 23 Drawing Sheets

(56) References Cited

U.S. PATENT DOCUMENTS

| | | | | |
|---|---|---|---|---|
| 7,110,941 | B2 * | 9/2006 | Li | 704/200.1 |
| 7,184,961 | B2 * | 2/2007 | Sato | 704/501 |
| 8,218,775 | B2 * | 7/2012 | Norvell et al. | 381/23 |
| 8,452,587 | B2 * | 5/2013 | Liu et al. | 704/203 |
| 8,504,378 | B2 * | 8/2013 | Liu et al. | 704/503 |
| 8,849,655 | B2 * | 9/2014 | Liu et al. | 704/222 |
| 2004/0049379 | A1 * | 3/2004 | Thumpudi et al. | 704/205 |
| 2005/0213522 | A1 | 9/2005 | Aarts et al. | |
| 2006/0190247 | A1 * | 8/2006 | Lindblom | 704/230 |
| 2007/0171944 | A1 | 7/2007 | Schuijers et al. | |
| 2007/0183601 | A1 | 8/2007 | Van Loon et al. | |
| 2007/0194952 | A1 | 8/2007 | Breebaart et al. | |
| 2007/0239442 | A1 | 10/2007 | Hotho et al. | |
| 2007/0269063 | A1 * | 11/2007 | Goodwin et al. | 381/310 |
| 2008/0021704 | A1 * | 1/2008 | Thumpudi et al. | 704/230 |
| 2009/0083044 | A1 * | 3/2009 | Briand et al. | 704/500 |
| 2009/0083045 | A1 | 3/2009 | Briand et al. | |
| 2009/0252341 | A1 * | 10/2009 | Goodwin | 381/56 |
| 2010/0121633 | A1 * | 5/2010 | Chong | 704/220 |
| 2011/0046946 | A1 | 2/2011 | Liu et al. | |

FOREIGN PATENT DOCUMENTS

| | | |
|---|---|---|
| WO | 2007/104883 | 9/2007 |
| WO | 2009/038512 | 3/2009 |
| WO | 2009/144953 | 12/2009 |

OTHER PUBLICATIONS

Jurgen Herre, "From Joint Stereo to Spatial Audio Coding-Recent Progress and Standardization", Proc. of the 7th Int. Conference on Digital Audio Effects, Naples, Italy, Oct. 5-8, 2004, PP.

Manuel Briand et al., "Parametric coding of stereo audio based on principal component analysis", Proc. of the 9th Int. Conference on Digital Audio Effects, Montreal, Canada, Sep. 18-20, 2006, PP.

Christof Faller et al., "Binaural Cue Coding—Part II: Schemes and Applications", IEEE Transactions on Speech and Audio Processing, vol. 11, No. 6, Nov. 2003, PP.

* cited by examiner

SPEECH CODING OF PRINCIPAL-COMPONENT CHANNELS FOR DELETING REDUNDANT INTER-CHANNEL PARAMETERS

TECHNICAL FIELD

The present invention relates to a speech coding apparatus and a speech coding method and more particularly relates to a speech coding apparatus and a speech coding method capable of deleting redundant inter-channel parameters.

BACKGROUND ART

Generally, a stereo speech coding method or a multi-channel speech coding method include two methods.

One is the method to individually encode different channel signals, and this method can be easily applied to stereo speech signals or multi-channel speech signals. However, since this method does not delete inter-channel redundancy, the entire coding bit rate becomes proportional to the number of channels, and hence results in a higher bit rate.

The other is the method to parametrically encode a stereo speech signal or a multi-channel speech signal. The basic principle of this method is as follows. That is, at first, a coding side down-mixes or transforms an input signal into a signal of fewer channels than (or the same number as) those of the input signal. Next, the coding side encodes the down-mixed or transformed signal using the conventional speech coding method. In parallel with this, the coding side calculates inter-channel parameters representing inter-channel relationship from an original signal, encodes and then transmits the inter-channel parameters to a decoding side such that the decoding side can generate a stereo image or a multi-channel image. This method can encode inter-channel parameters with a smaller amount of coding than the amount of coding to encode a speech signal itself, thus making it possible to realize a lower bit rate.

A parametric stereo coding system or a multi-channel coding system widely use a principal component analysis (PCA) (Non-Patent Literature 1), a binaural cue coding method (BCC) (Non-Patent Literature 2), an inter-channel prediction (ICP) (Non-Patent Literature 3), and intensity stereo (IS) (Non-Patent Literature 4). The above methods generate and then transmit certain inter-channel parameters to a decoding side. For example, a binaural cue coding method (BCC) generates inter-channel level difference (ICLD), inter-channel time difference (ICTD), and inter-channel coherence (ICC) as the inter-channel parameters. Also, as inter-channel parameters, an inter-channel prediction (ICP), intensity stereo (IS), and a principal component analysis (PCA) generate an inter-channel prediction coefficient, an energy scale coefficient, and a rotation angle, respectively.

Since BCC, ICP, IS, and PCA require to obtain highly precise inter-channel parameters, it is general to calculate and encode the inter-channel parameters on a subband basis.

FIG. 1 and FIG. 2 simply illustrate configurations of parametric multi-channel codecs, and the meanings of signs in FIG. 1 and FIG. 2 are as follows.

$\{x_{i_sb}\}$: a series of multi-channel signals divided into a plurality of subbands (which represents signals in a frequency domain, a time domain, or a hybrid domain where the frequency domain and the time domain are combined)

$\{y_{i_sb}\}$: a series of down-mixed or transformed signals calculated every subband (which are the signals in the same domain as $\{x_{i_sb}\}$)

$\{P_{i_sb}\}$: a series of inter-channel parameters calculated every subband

The following will be explained assuming that down-mixing is performed.

At the coding side illustrated in FIG. 1, inter-channel parameter generating section 101 down-mixes input signals $\{x_{i_sb}\}$ by BCC, PCA or the like, and generates down-mixed signals $\{y_{i_sb}\}$ and inter-channel parameters $\{P_{i_sb}\}$.

Coding section 102 encodes down-mixed signal $\{y_{i_sb}\}$, and coding section 103 (inter-channel parameter coding section), which is separately provided, encodes the inter-channel parameters $\{P_{i_sb}\}$.

Multiplexing section 104 multiplexes coding parameters of down-mixed signals $\{y_{i_sb}\}$ and coding parameters of inter-channel parameters $\{P_{i_sb}\}$, which generates a bit stream. This bit stream is transmitted to a decoding side.

At the decoding side illustrated in FIG. 2, demultiplexing section 201 demultiplexes the bit stream to obtain coding parameters of the down-mixed signals and the inter-channel parameters.

Decoding section 202 performs decoding processing using the coding parameters of the down-mixed signals, and generates decoded down-mixed signals $\{y_{i_sb}\}$.

Decoding section 203 (inter-channel parameter decoding section) performs decoding processing using the coding parameters of the inter-channel parameters, and generates decoded inter-channel parameters $\{P_{i_sb}\}$.

Inter-channel parameter applying section 204 up-mixes decoded down-mixed signals $\{y_{i_sb}\}$ using spatial information represented by the decoded inter-channel parameters $\{P_{i_sb}\}$, and generates decoded signals $\{x_{i_sb}\}$.

Non-Patent Literature 1 describes a codec based on a principal component analysis (PCA) in the frequency domain. FIG. 3 and FIG. 4 illustrate configurations of a coding apparatus and a decoding apparatus based on PCA in Non-Patent Literature 1. The meanings of signs are as follows.

$\{L_{sb}(f)\}$: left signals divided into a plurality of subbands $\{R_{sb}(f)\}$: right signals divided into a plurality of subbands $\{Pc_{sb}(f)\}$: principal-component signals calculated every subband by a principal component analysis $\{A_{sb}(f)\}$: ambient signals calculated every subband by a principal component analysis $\{\theta_{sb}\}$: rotation angles calculated every subband by a principal component analysis $\{PcAR_{sb}\}$: energy ratios of principal component signals to ambient signals, the ratios calculated every subband At a coding side illustrated in FIG. 3, principal component analyzing section 301 transforms input left signals $\{L_{sb}(f)\}$ and input right signals $\{R_{sb}(f)\}$ into principal-component signals $\{Pc_{sb}(f)\}$ and ambient signals $\{A_{sb}(f)\}$. In this transforming processing, the rotation angles each representing a transform degree are calculated every subband as the following.

(Equation 1)

$$\theta_{sb} = \frac{1}{2}\tan^{-1}\left(\frac{2\left|\sum_{f=sb_start|}^{sb_end} L_{sb}(f) * R_{sb}(f)\right|}{\sum_{f=sb_start}^{sb_end} L_{sb}(f)^2 - \sum_{f=sb_start}^{sb_end} R_{sb}(f)^2}\right) \quad [1]$$

$$\theta_{sb} = \theta_{sb} + \frac{\pi}{2} \text{ if } \theta_{sb} < 0$$

The transform of a principal component analysis is performed as the following equation.

(Equation 2)

$$Pc_{sb}(f)=L_{sb}(f)*\cos\theta_{sb}+R_{sb}(f)*\sin\theta_{sb}$$

$$A_{sb}(f)=R_{sb}(f)*\cos\theta_{sb}-L_{sb}(f)*\sin\theta_{sb} \quad [2]$$

Monaural coding section 303 encodes principal-component signals $\{Pc_{sb}(f)\}$.

Coding section 302 (rotation angle coding section) encodes rotation angles $\{\theta_{sb}\}$.

Ambient signals $\{A_{sb}(f)\}$ are not regarded as important and thereby are not directly encoded. Energy parameter extracting section 304 calculates energy ratios $\{PcAR_{sb}\}$ of principal-component signals to ambient signals, and coding section 305 (energy ratio coding section) encodes the energy ratios $\{PcAR_{sb}\}$ and generates energy ratio coding parameters. The energy ratios $\{PcAR_{sb}\}$ are calculated as the following equation.

(Equation 3)

$$PcAR_{sb}=\frac{\sum_{f=sb_start}^{sb_end} Pc_{sb}(f)^2}{\sum_{f=sb_start}^{sb_end} A_{sb}(f)^2} \quad [3]$$

Multiplexing section 306 multiplexes coding parameters of principal-component signals $\{Pc_{sb}(f)\}$, rotation angles $\{\theta_{sb}\}$, and energy ratios $\{PcAR_{sb}\}$, and transmits a bit stream to a decoding side.

At the decoding side illustrated in FIG. 4, demultiplexing section 401 demultiplexes the bit stream, and obtains coding parameters of the principal-component signals, coding parameters of the rotation angles, and coding parameters of the energy ratios.

Decoding section 402 (rotation angle decoding section) decodes the coding parameters of the rotation angles and outputs the decoded rotation angles $\{\theta_{i_sb}\}$ to principal component combining section 406.

Monaural decoding section 403 decodes the coding parameters of the principal-component signals, generates and then outputs decoded principal-component signals $\{Pc_{sb}(f)\}$ to principal component combining section 406 and ambient signal combining section 405.

Decoding section 404 (energy ratio decoding section) decodes the coding parameters of the energy ratios and generates decoded energy ratios $\{PcAR_{sb}\}$ of the principal-component signals to the ambient signals.

By scaling the decoded principal-component signals $\{Pc_{sb}(f)\}$ by the decoded energy ratios, ambient signal combining section 405 generates decoded ambient signals $\{A_{sb}(f)\}$.

Principal component combining section 406 inversely transforms decoded principal-component signals $\{Pc_{sb}(f)\}$ and decoded ambient signals $\{A_{sb}(f)\}$ by decoded rotation angles $\{\theta_{i_sb}\}$, and generates decoded left signals $\{L_{sb}(f)\}$ and decoded right signals $\{R_{sb}(f)\}$. This inverse transformation is performed as the following equation.

(Equation 4)

$$\tilde{L}_{sb}(f)=\tilde{P}c_{sb}(f)*\cos\tilde{\theta}_{sb}-\tilde{A}_{sb}(f)*\sin\tilde{\theta}_{sb}$$

$$\tilde{R}_{sb}(f)=\tilde{P}c_{sb}(f)*\sin\tilde{\theta}_{sb}+\tilde{A}_{sb}(f)*\cos\tilde{\theta}_{sb} \quad [4]$$

In the case that the ambient signals are not encoded, the inverse transformation is performed as the following equation.

(Equation 5)

$$\tilde{L}_{sb}(f)=\tilde{P}c_{sb}(f)*\cos\tilde{\theta}_{sb}$$

$$\tilde{R}_{sb}(f)=\tilde{P}c_{sb}(f)*\sin\tilde{\theta}_{sb} \quad [5]$$

CITATION LIST

Non-Patent Literature

NPL 1

Manuel Briand, David Virette and Nadine Martin "Parametric coding of stereo audio based on principal component analysis", Proc of the 9th International Conference on Digital Audio Effects, Montreal, Canada, Sep. 18-20, 2006.

NPL 2

Christof Faller and Frank Baumgarte "Binaural Cue Coding—Part II: Schemes and Applications", IEEE Transactions on Speech and Audio Processing, Vol. 11, No 6, November 2003

NPL 3

Hendrik Fuchs "Improving Joint Stereo Audio Coding by Adaptive Inter-channel Prediction", Proc of IEEE ASSP Workshop on Applications of Signal Processing to Audio and Acoustics, New Paltz, N.Y., USA, Oct. 17-20, 1993

NPL 4

Jurgen Herre, "From Joint Stereo to Spatial Audio Coding—Recent Progress and Standardization", Proc of the 7th International Conference on Digital Audio Effects, Naples, Italy, Oct. 5-8, 2004.

SUMMARY OF INVENTION

Technical Problem

Irrespective of coding quality or signal-level sizes of down-mixed signals $\{y_{i_sb}\}$, the above conventional art encodes inter-channel parameters at a predetermined bit rate. Even when the down-mixed signals are not encoded at all in one or a plurality of subbands, the inter-channel parameter coding is performed irrespective of this situation.

Here, let us consider, as an example, a case where down-mixed signals of one or a plurality of subbands are not encoded, in the case of an extremely low bit rate. In these subbands where down-mixed signals are not encoded, the inter-channel parameters are unnecessary in generating multi-channel speech signals, and coding of these unnecessary parameters results in wasting bits used in the coding processing.

Hereinafter, a case will be described exemplifying the above codec based on a principal component analysis in the frequency domain.

It is assumed that when input signals are represented as L(n) and R(n), these signals can be represented as L(n)=S(n)+C(n) and R(n)=S(n)+B(n) (S(n) means the main source signal, and C(n) and B(n) means certain ambient noise).

In the case of the frequency domain, L(f)=S(f)+C(f) and R(f)=S(f)+B(f) hold true. In the subband where S(f) is not so strong, the ambient noise is dominant; that is, C(f) is dominant in L(f) and B(f) is dominant in R(f). In this case, these types of subbands are not so important in the whole spectrum that signals in these subbands are not encoded in the case of a low bit rate. Therefore, coding of rotation angles in these subbands is essentially not necessary. For this reason, the conventional art which always encodes the rotation angles of all subbands wastes the bits allocated to the coding of the rotation angles in these subbands.

Referring to FIG. 5 illustrating the above problematic case, under the condition of a low bit rate, the coding side does not encode principal-component signal $Pc_2(f)$ of the second subband of which energy of the principal-component signal is smaller than the energy of other subbands. Therefore, in the decoding side, the decoded principal-component signal of the second subband is 0. Since ambient signals are generated by scaling the principal-component signals, the ambient signal of the second subband also is 0. In this case, even if the rotation angle has any value, decoded left signal $L_2(f)$ and decoded right signal $R_2(f)$ of the second subband become 0. That is, the decoded left signal and the decoded right signal of the second subband are the same regardless of whether or not the rotation angle is transmitted.

It is therefore an object of the present invention to provide a speech coding apparatus and a speech coding method capable of deleting the redundant inter-channel parameters.

Solution to Problem

In the first aspect of the present invention, before encoding and transmitting inter-channel parameters, a coding apparatus analyzes signal characteristics of each subband signal and checks whether or not it is necessary to transmit inter-channel parameters. Then, the coding apparatus selects inter-channel parameters not necessary to be transmitted and deletes the parameters from coding targets.

By this means, it is possible to delete the unnecessary inter-channel parameters from the coding targets and to prevent encoding the unnecessary parameters, which makes it possible to improve a coding efficiency without wasting bits.

In the second aspect of the present invention, redundant parameters are selected by a closed loop method. Introduction of a local decoding section at the coding side and analysis of signal coding quality selects the redundant parameters. By analyzing the energy or amplitude of decoded down-mix signals generated via the local decoding section, the subband with small energy or amplitude is regarded as a subband having a redundant inter-channel parameter. Deletion of the inter-channel parameter of this subband from the coding targets prevents a possibility of decreasing sound quality.

By this means, the local decoding section can select the subband having the redundant parameter (unimportant inter-channel parameter).

In the third aspect of the present invention, the redundant parameters are selected by an open loop method. An analysis of the characteristics of transformed or down-mixed original signals selects the redundant parameters.

Therefore, the present embodiment does not require a local decoding section and is useful in the condition incapable of using the local decoding section. Also, absence of the local decoding section can reduce the amount of calculations.

In the fourth aspect of the present invention, after decoding, the decoding side analyzes the transformed or down-mixed signals and selects the subband without an inter-channel parameter. Therefore, flag signals are not required, the signals reporting to the decoding section that a specific subband does not include the inter-channel parameter.

By this means, unnecessity of additional information representing the flag signals can improve the coding efficiency.

The fifth aspect of the present invention uses the bits saved by applying the present invention in order to encode certain more important signals (for example, the coding parameters of the principal-component signals, and the coding parameters of the transformed or down-mixed signals).

Thus, realization of more precise bit allocation can improve the coding efficiency.

In the sixth aspect of the present invention, the decoding side predicts non-existent inter-channel parameters from parameters of adjacent subbands, parameters of a former frame, or both of them. The predicted value is used on inverse transformation or up-mixing.

By this means, it is possible to predict non-existent inter-channel parameters and to maintain spatial images.

The seventh aspect of the present invention applies the present invention for scalable coding. In each layer, before encoding and transmitting inter-channel parameters, the coding apparatus analyzes the characteristics of the transformed or down-mixed signals every subband signal, and checks whether or not it is necessary to transmit inter-channel parameters. Then, the coding apparatus selects the inter-channel parameter not necessary to be transmitted and deletes the parameter from the coding targets. In the case of a layer where inter-channel parameters are necessary to generate input signals, the coding apparatus transmits the inter-channel parameters.

By this means, since the coding apparatus transmits the inter-channel parameters only in the case of the layer requiring the inter-channel parameters, it is possible to realize precise bit allocation.

DESCRIPTION OF EMBODIMENTS

Embodiments of the present invention will now be described with reference to the accompanying drawings.

Embodiment 1

The present embodiment will be described referring to FIG. 6 to FIG. 9.

Figure 1:
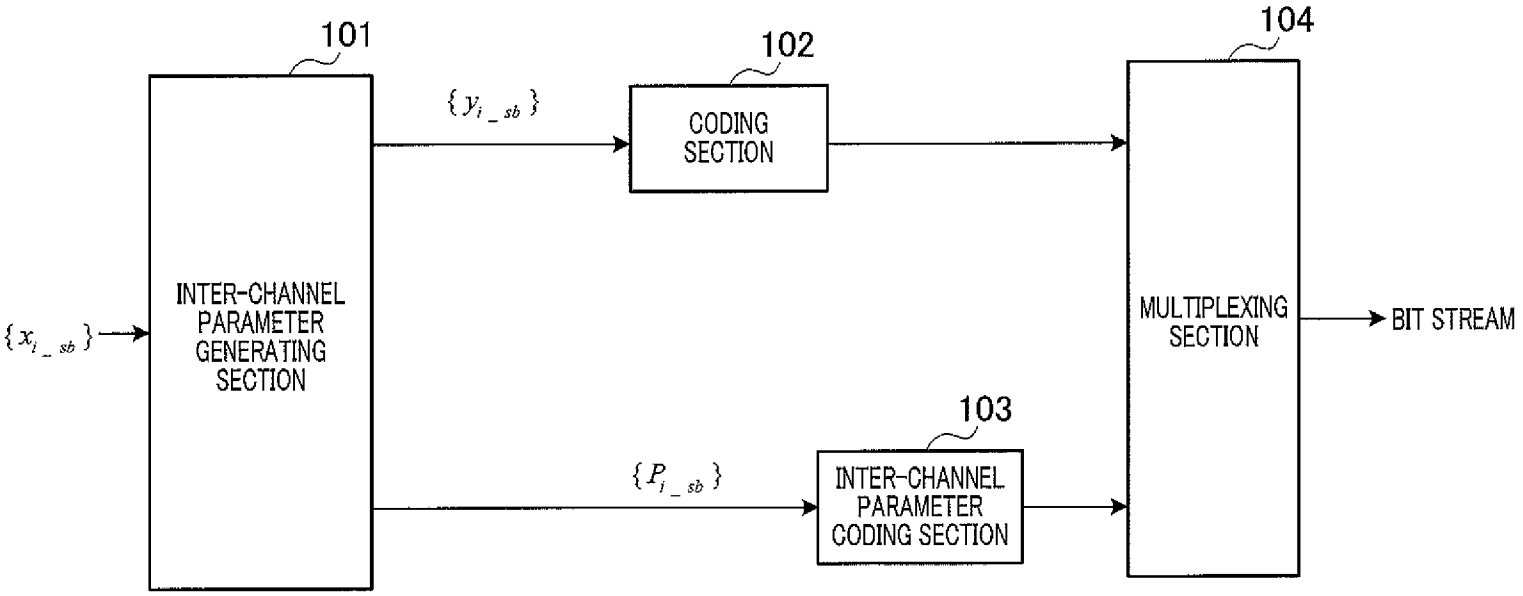
FIG.1 PRIOR ART
FIG. 1 illustrates a coding side configuration in parametric multi-channel speech coding.
Figure 2:
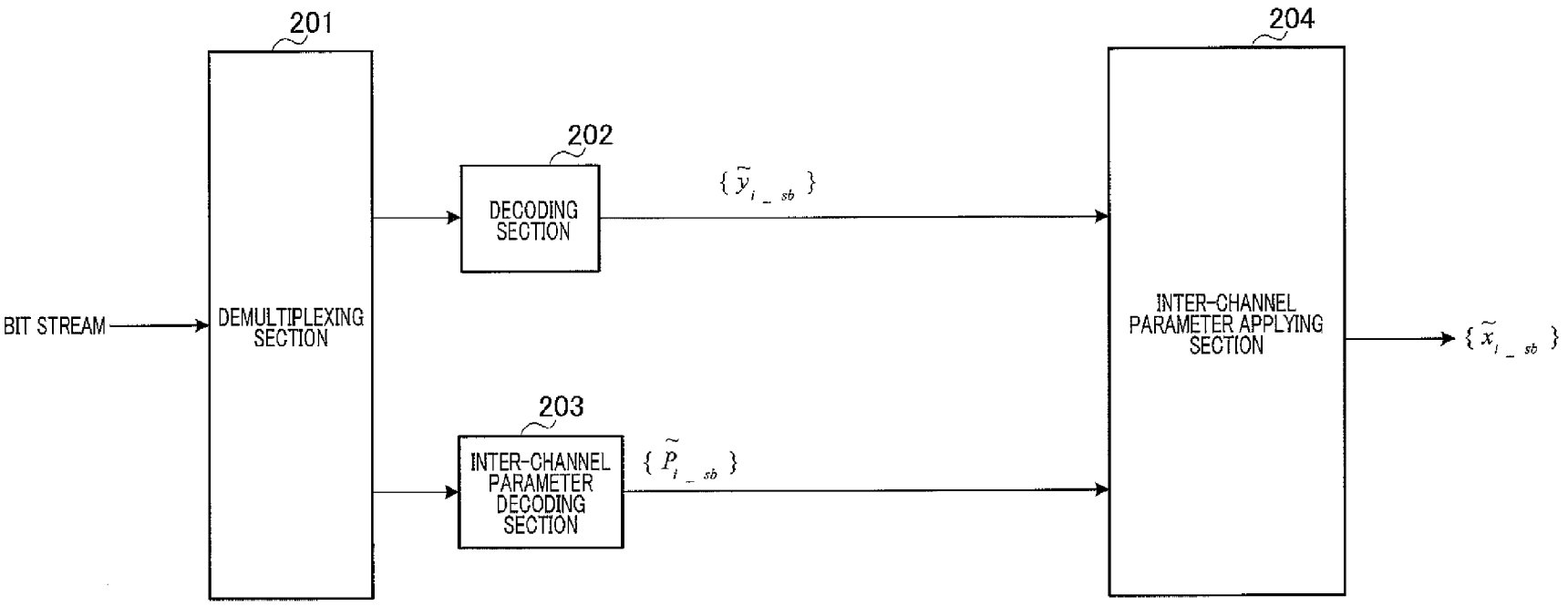
FIG.2 PRIOR ART
FIG. 2 illustrates a decoding side configuration in parametric multi-channel speech coding.
Figure 3:
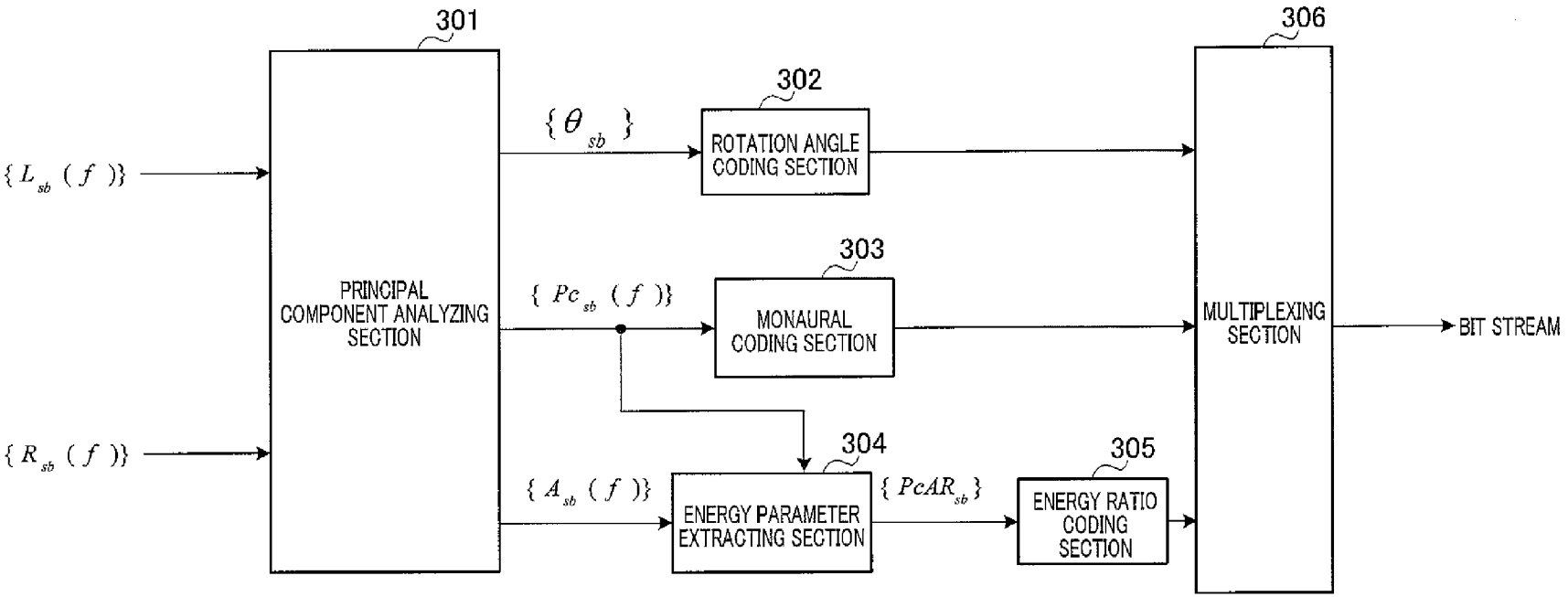
FIG.3 PRIOR ART
FIG. 3 illustrates a coding side configuration in stereo codec based on PCA.
Figure 6:
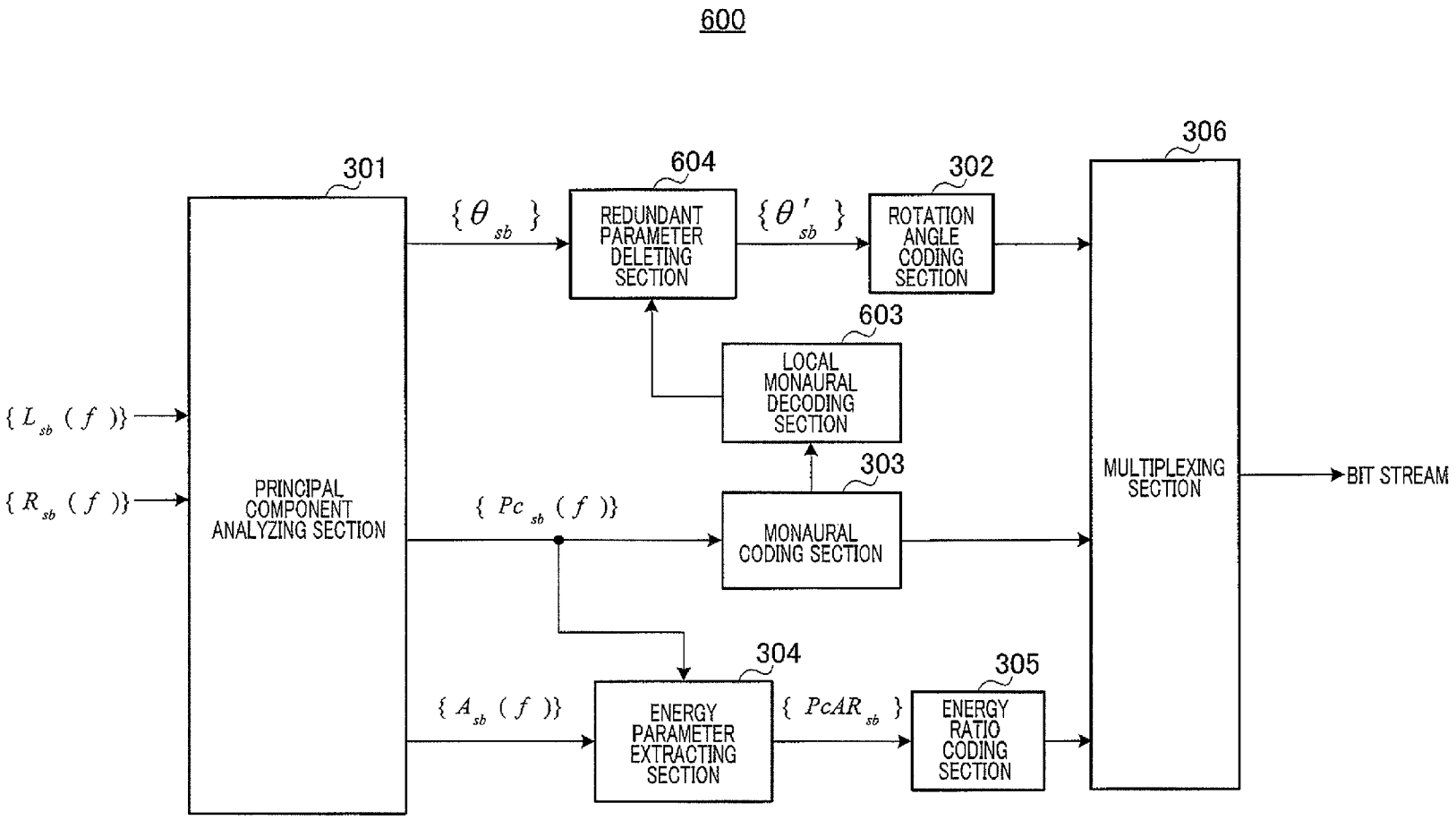
FIG. 6 illustrates a configuration of a speech coding apparatus according to embodiment 1 of the present invention in stereo codec based on PCA.

FIG. 6 illustrates a configuration of speech coding apparatus 600 according to the present embodiment. FIG. 6 additionally includes local monaural decoding section 603 and redundant parameter deleting section 604, in comparison with FIG. 3. In FIG. 6, descriptions on the components as the same as those in FIG. 3 will be omitted.

Local monaural decoding section 603 generates decoded principal-component signals such that a coding side can confirm the coding quality of the principal-component signals.

Through analysis of the coding quality of the decoded principal-component signals, redundant parameter deleting section 604 selects redundant parameters and deletes these parameters from coding targets.

The coding processing according to the present embodiment will be described referring to FIG. 7.

Figure 7:
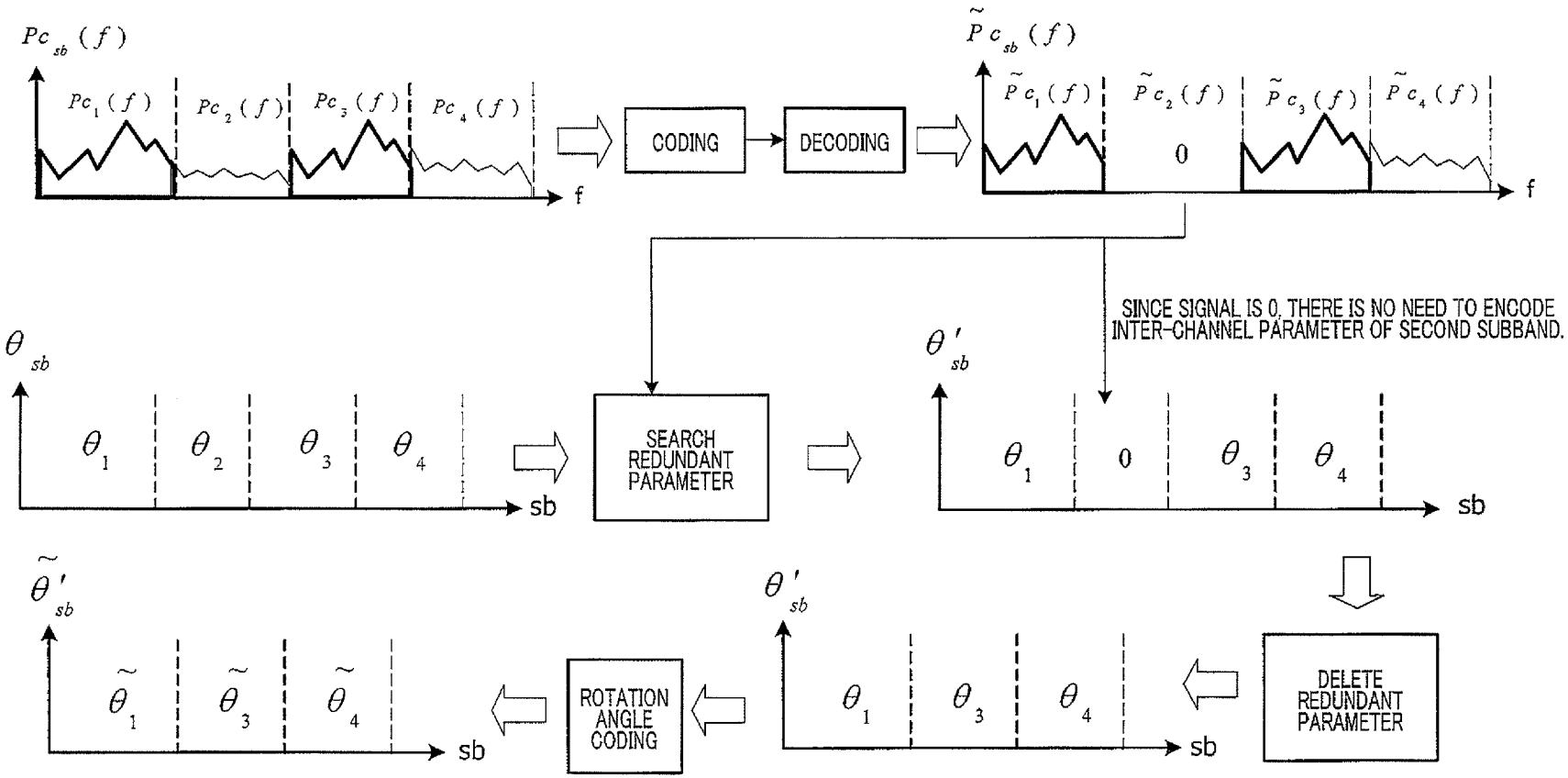
FIG. 7 illustrates a coding processing according to embodiment 1 of the present invention in stereo codec based on PCA.

As illustrated in FIG. 7, spectra of the principal-component signals are encoded and decoded. Analyzing the decoded spectra after generating the decoded spectrum, shows that the principal component of the second subband is not encoded at all, and therefore the decoded spectrum of the second subband is 0. Thus, there is no need to encode the rotation angle of the second subband. For this reason, the rotation angle of the second subband is regarded as a redundant parameter, and this parameter is deleted from the coding targets before encoding.

Figure 4:
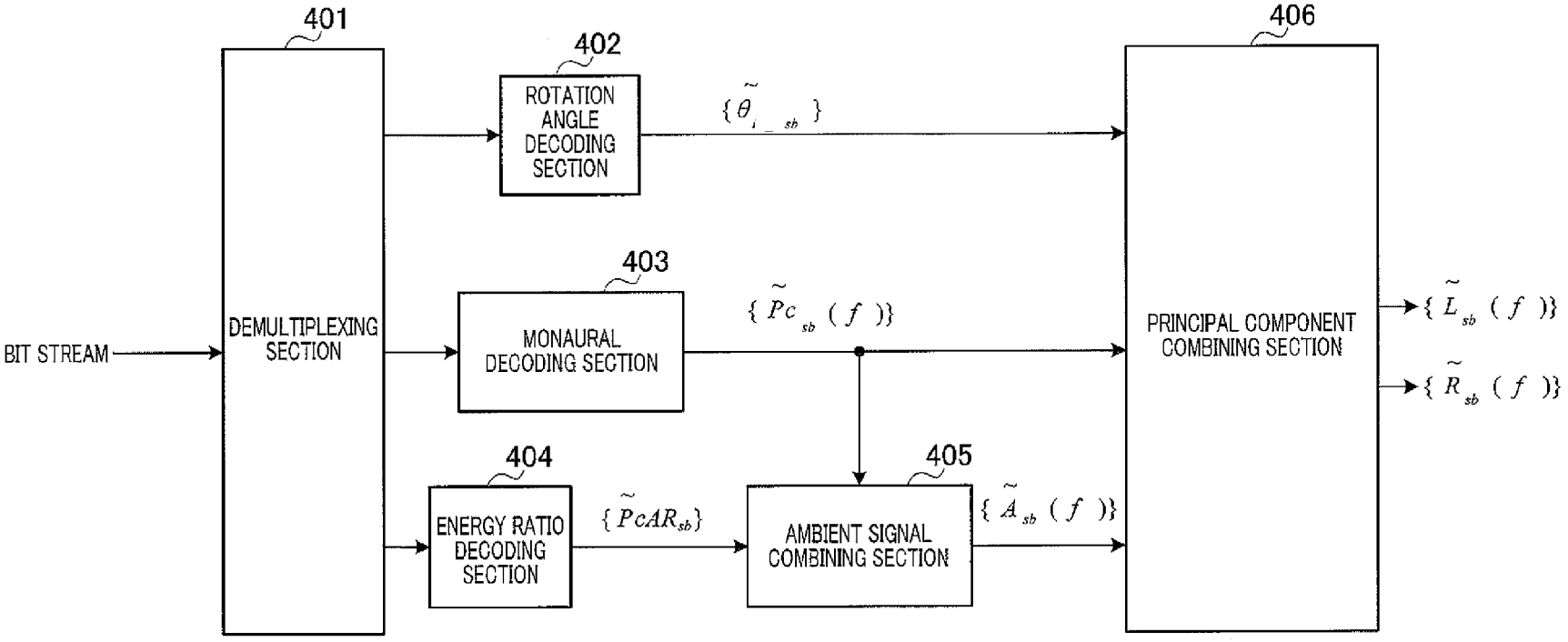
FIG.4 PRIOR ART
FIG. 4 illustrates a decoding side configuration in stereo codec based on PCA.
Figure 5:
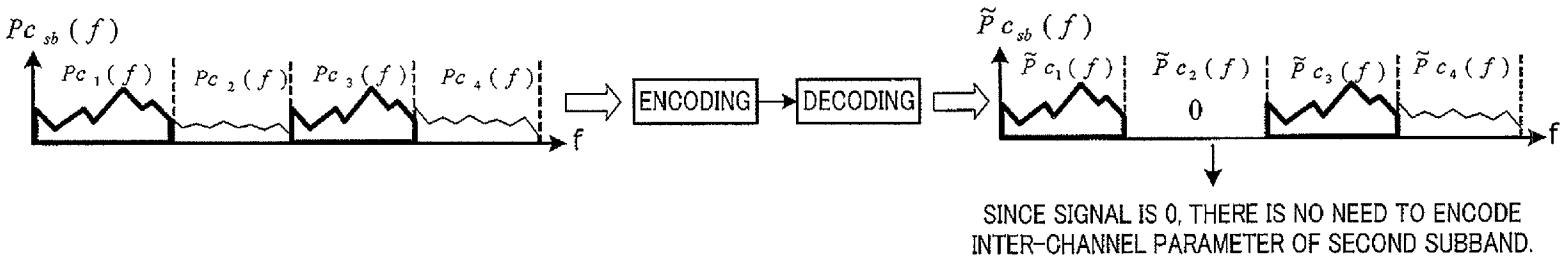
FIG. 5 illustrates a problem in stereo codec based on PCA.
Figure 8:
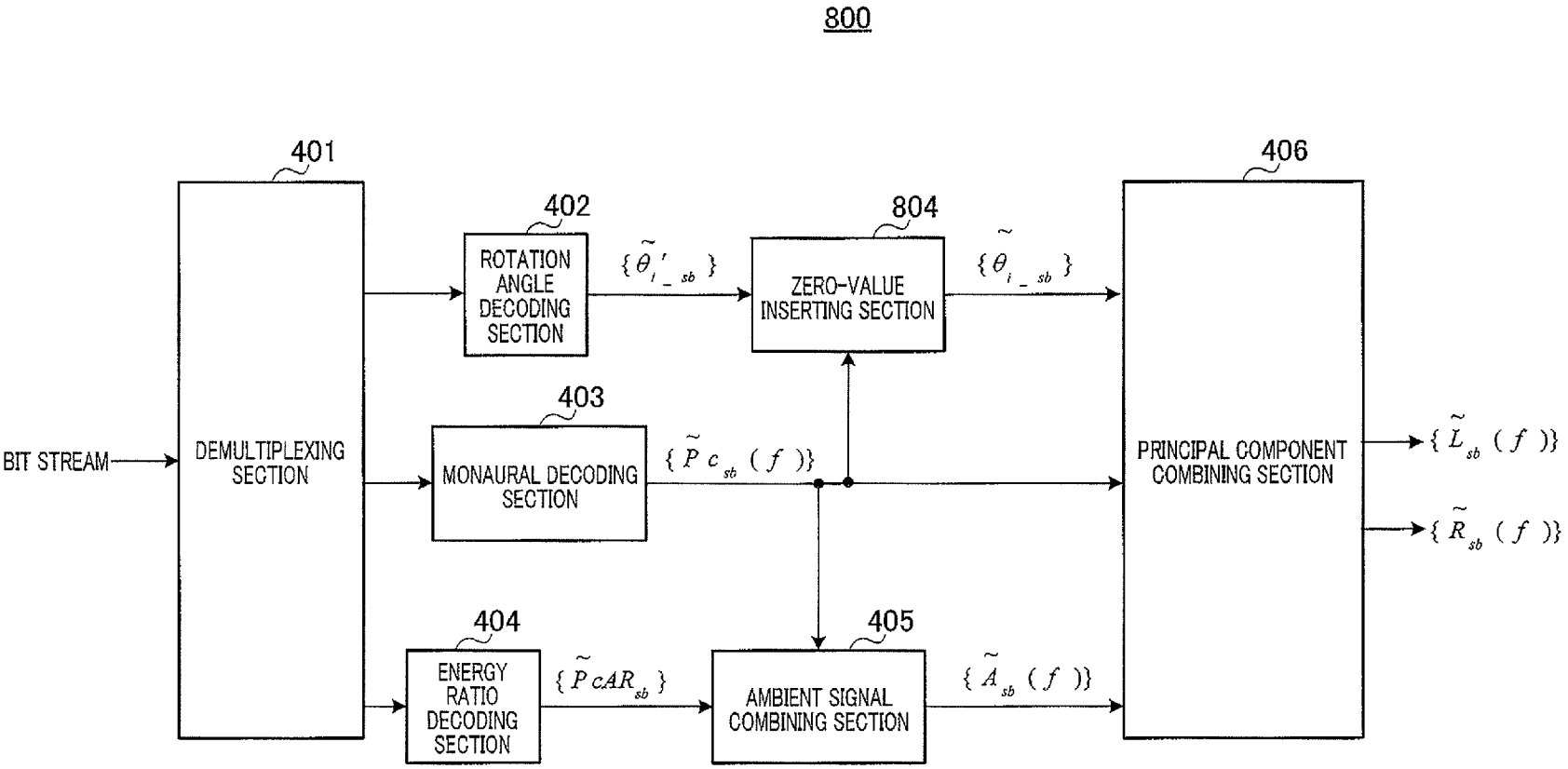
FIG. 8 illustrates a configuration of a speech decoding apparatus according to embodiment 1 of the present invention in stereo codec based on PCA.

FIG. 8 illustrates a configuration of speech decoding apparatus 800 according to the present embodiment. FIG. 8 additionally includes zero-value inserting section 804, in comparison with FIG. 4. In FIG. 8, descriptions on the components as the same as those in FIG. 4 will be omitted.

Zero-value inserting section 804 analyzes the decoded principal-component signals, selects the subband without a rotation angle, and inserts a zero value to the subband, so that inverse transformation can be performed smoothly.

The decoding processing according to the present embodiment will be described referring to FIG. 9.

Figure 9:
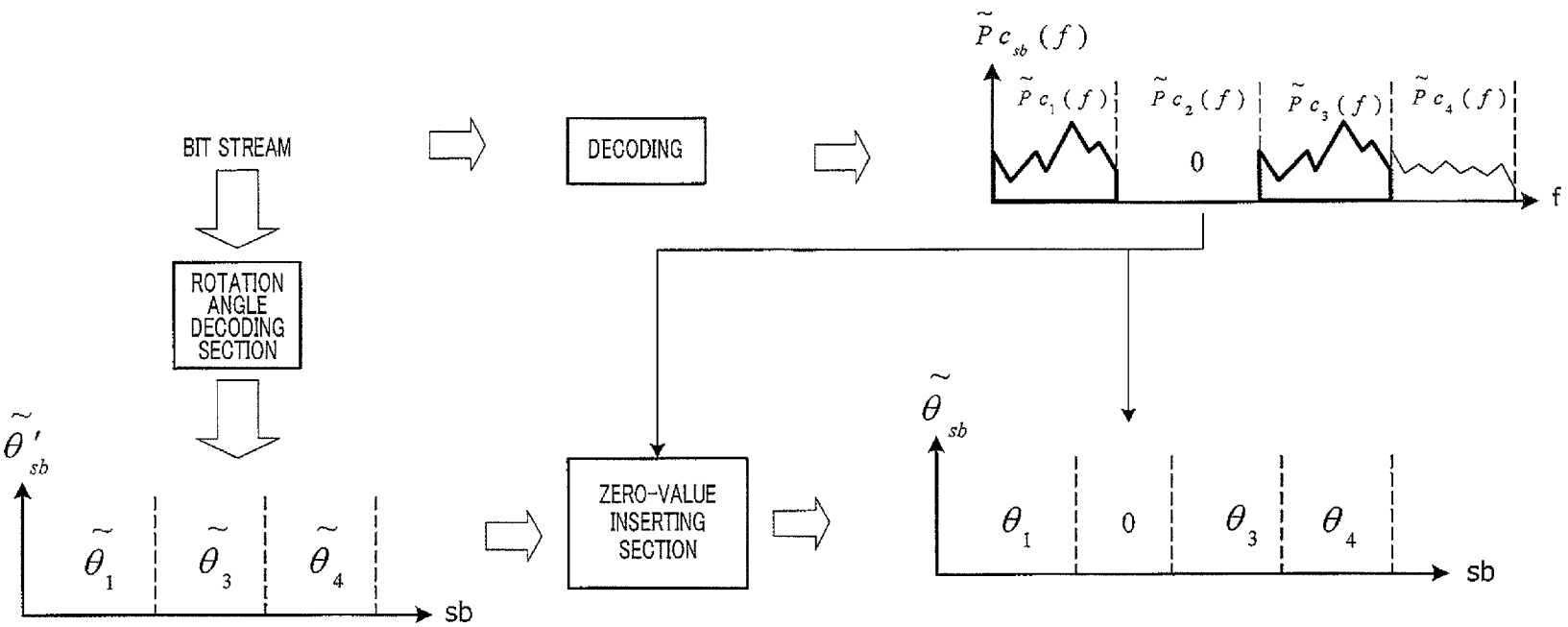
FIG. 9 illustrates decoding processing according to embodiment 1 of the present invention in stereo codec based on PCA.

As illustrated in FIG. 9, analyzing the decoded principal-component signals after generating the decoded principal-component, shows that the decoded principal-component signal of the second subband is 0 and that the rotation angle in the second subband is not encoded. Therefore, the decoding side decodes only rotation angles of other subbands. Also, in order to perform decoding processing smoothly, the decoding side inserts a zero value as the decoded rotation angle of the second subband.

The present invention can be applied to encoding of the energy ratios of principal-component signals to ambient signals.

Embodiment 2

The present embodiment will be described referring to FIG. 10 to FIG. 13. The meanings of signs in FIG. 10 to FIG. 13 are as follows.

$\{x_{i_sb}\}$: multi-channel signals divided into a plurality of subbands (which represents signals in a frequency domain, a time domain, or a hybrid domain where the frequency domain and the time domain are combined)

$\{y_{i_sb}\}$: down-mixed or transformed signals divided into a plurality of subbands (which are the signals in the same domains as $\{x_{i_sb}\}$)

$\{P_{i_sb}\}$: inter-channel parameters calculated every subband $\{x_{i_sb}\}$: decoded signals of $\{x_{i_sb}\}$ $\{y_{i_sb}\}$: decoded signals of $\{y_{i_sb}\}$ $\{P_{i_sb}\}$: decoded inter-channel parameters The present embodiment deletes redundant parameters in multi-channel speech coding.

Figure 10:
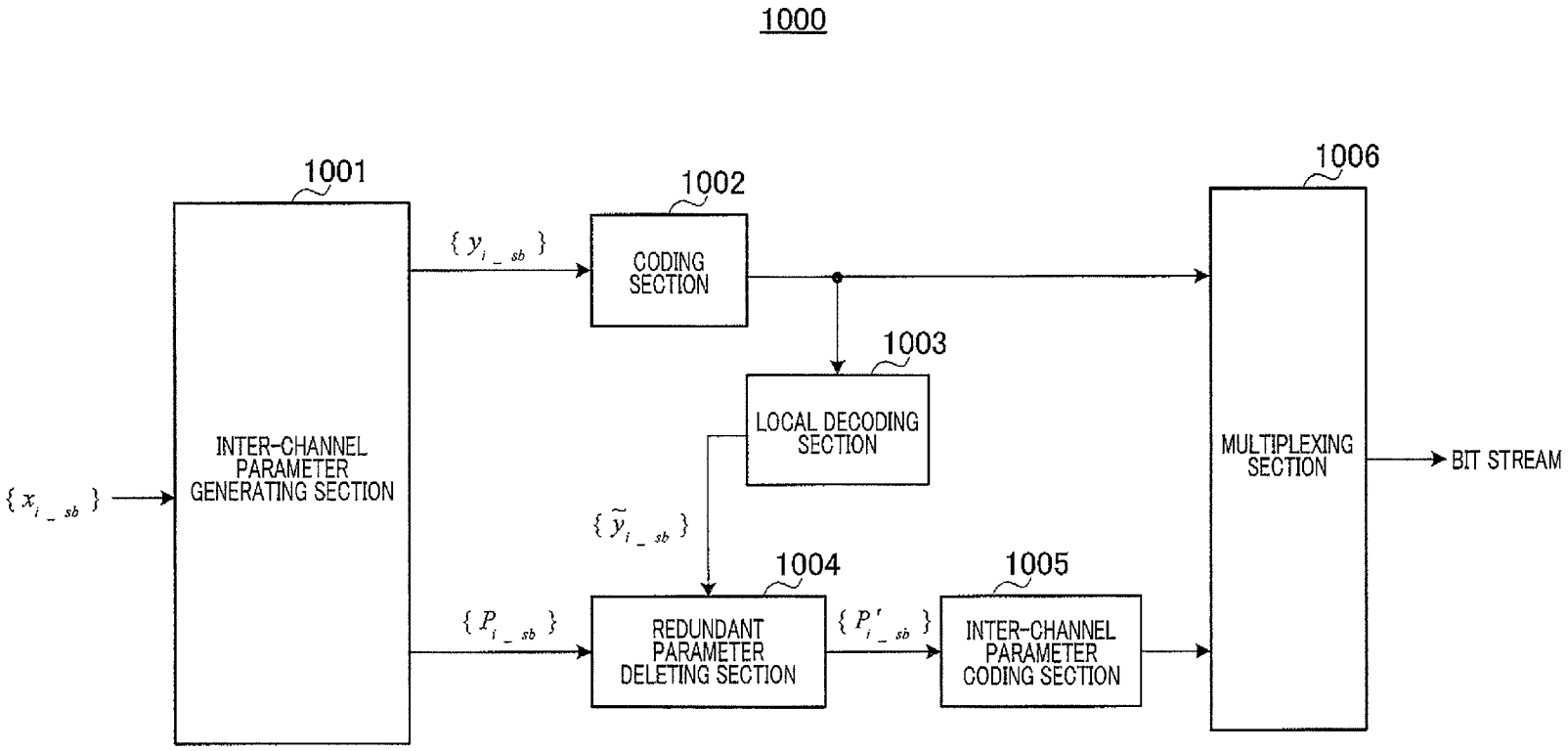
FIG. 10 illustrates a configuration of a speech coding apparatus according to embodiment 2 of the present invention in multi-channel speech coding.

FIG. 10 illustrates a configuration of speech coding apparatus 1000 according to the present embodiment.

In speech coding apparatus 1000, inter-channel parameter generating section 1001 transforms or down-mixes input signals $\{x_{i_sb}\}$ into $\{y_{i_sb}\}$ by BCC, PCA or the like. During transforming and down-mixing processing, inter-channel parameter generating section 1001 also generates inter-channel parameters $\{P_{i_sb}\}$.

Coding section 1002 encodes the transformed or down-mixed signals $\{y_{i_sb}\}$.

Local decoding section 1003 generates signals transformed or down-mixed after decoding, such that the coding side can identify coding quality of the transformed or down-mixed signals.

By analyzing the coding quality of the transformed or down-mixed signals, deleting section 1004 selects redundant parameters and deletes these parameters from coding targets.

Coding section 1005 (inter-channel parameter coding section) encodes the remaining inter-channel parameters $\{P'_{i_sb}\}$ after the deletion of the redundant parameters.

Multiplexing section 1006 multiplexes coding parameters of $\{y_{i_sb}\}$ and coding parameters of $\{P'_{i_sb}\}$, generates and then transmits a bit stream to the decoding side.

The coding processing according to the present embodiment will be described referring to FIG. 11.

Figure 11:
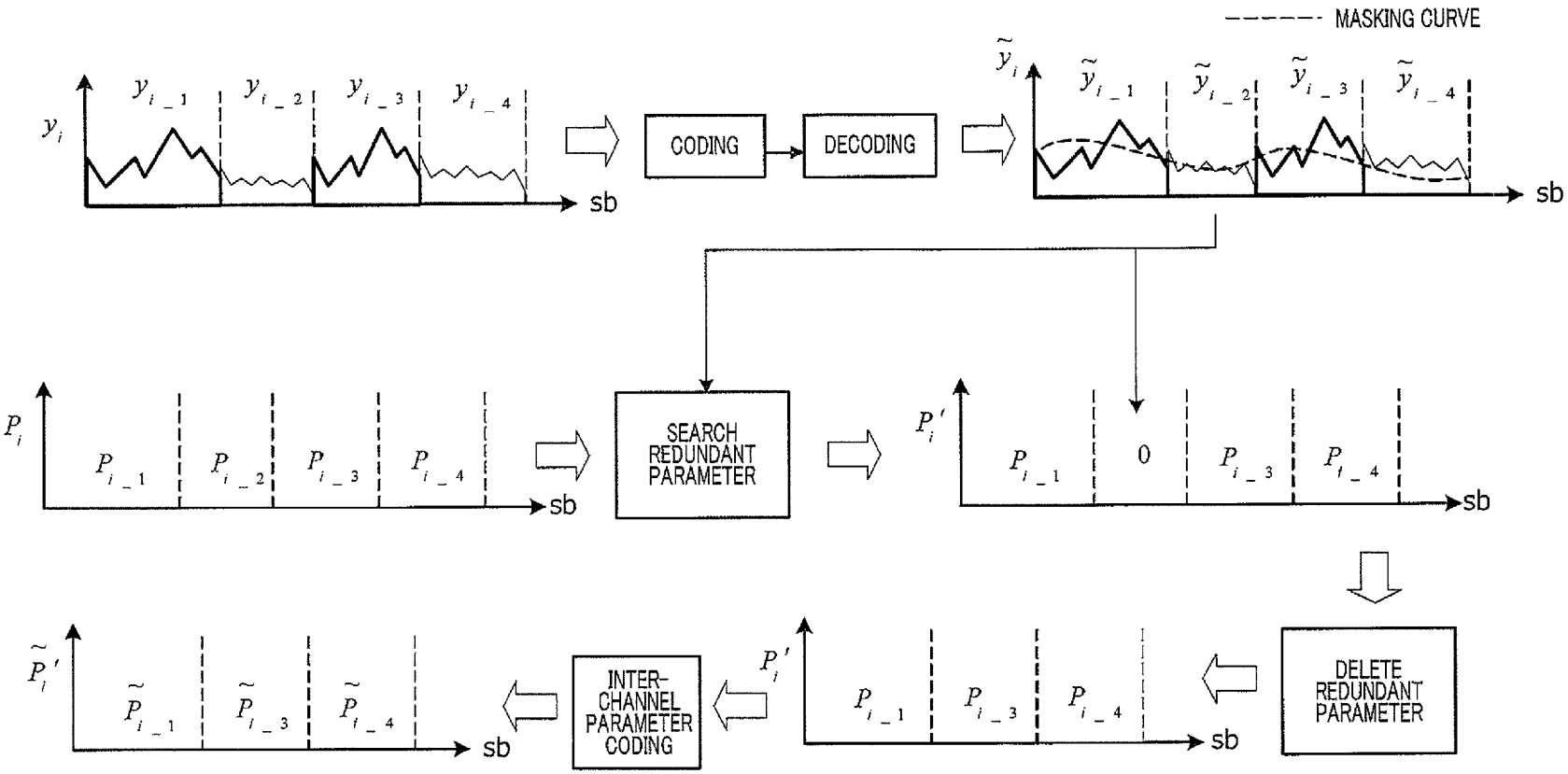
FIG. 11 illustrates coding processing according to embodiment 2 of the present invention in multi-channel speech coding.

As illustrated in FIG. 11, spectra of the transformed or down-mixed signals are encoded and decoded. Analyzing the decoded spectra after generating the decoded spectra, shows that, since the transformed or down-mixed signal, for example in the second subband, is critically weak (in an extreme case, the second subband is not encoded at all), the decoded signal is 0. In this case, there is no need to encode the inter-channel parameter of the second subband. Therefore, the inter-channel parameter of the second subband is regarded as the redundant parameter, and deletes this parameter from the coding targets before encoding.

There are many methods, such as the following two, to determine whether or not the decoded subband signals are sufficiently weak. However, the present invention is not limited to the following methods.

<Method 1> Case Where Signal Energy of Subband is Extremely Lower than Adjacent Subbands Every subband, this method calculates energy $\{E_{sb}\}$ and energy ratios of the subband to the adjacent subbands, and then compares the energy ratios with a predetermined value $E_{th}$ ($E_{th}<1$). When both energy ratios are smaller than $E_{th}$, the subband signal is regarded as weak. For example, two energy ratios $E_2/E_1$ and $E_2/E_3$ are calculated in the second subband. If $E_2/E_1<E_{th}$ and $E_2/E_3<E_{th}$ hold true, the signal of the second subband is regarded as weak in this case. In this case, the inter-channel parameter of the second subband is regarded as the redundant parameter.

<Method 2> Case Where Subband Signal is Close to or Lower than Masking Curve

Every subband, this method calculates energy $\{E_{sb}\}$ and masking curve level $\{M_{sb}\}$, and then compares the masking curve level with the subband energy. In this case, it is possible to define another threshold $M_{th}$ ($M_{th}>0$). When the subband energy is smaller than or close to a masking curve, that is, $E_{sb}<M_{sb}+M_{th}$ holds true, the subband signal is regarded as weak. For example, subband energy $E_2$ is compared with masking curve level $M_2$. If $E_2<M_2+M_{th}$ holds true, the signal of the second subband is regarded as weak. Therefore, the inter-channel parameter in the second subband is regarded as the redundant parameter.

Figure 12:
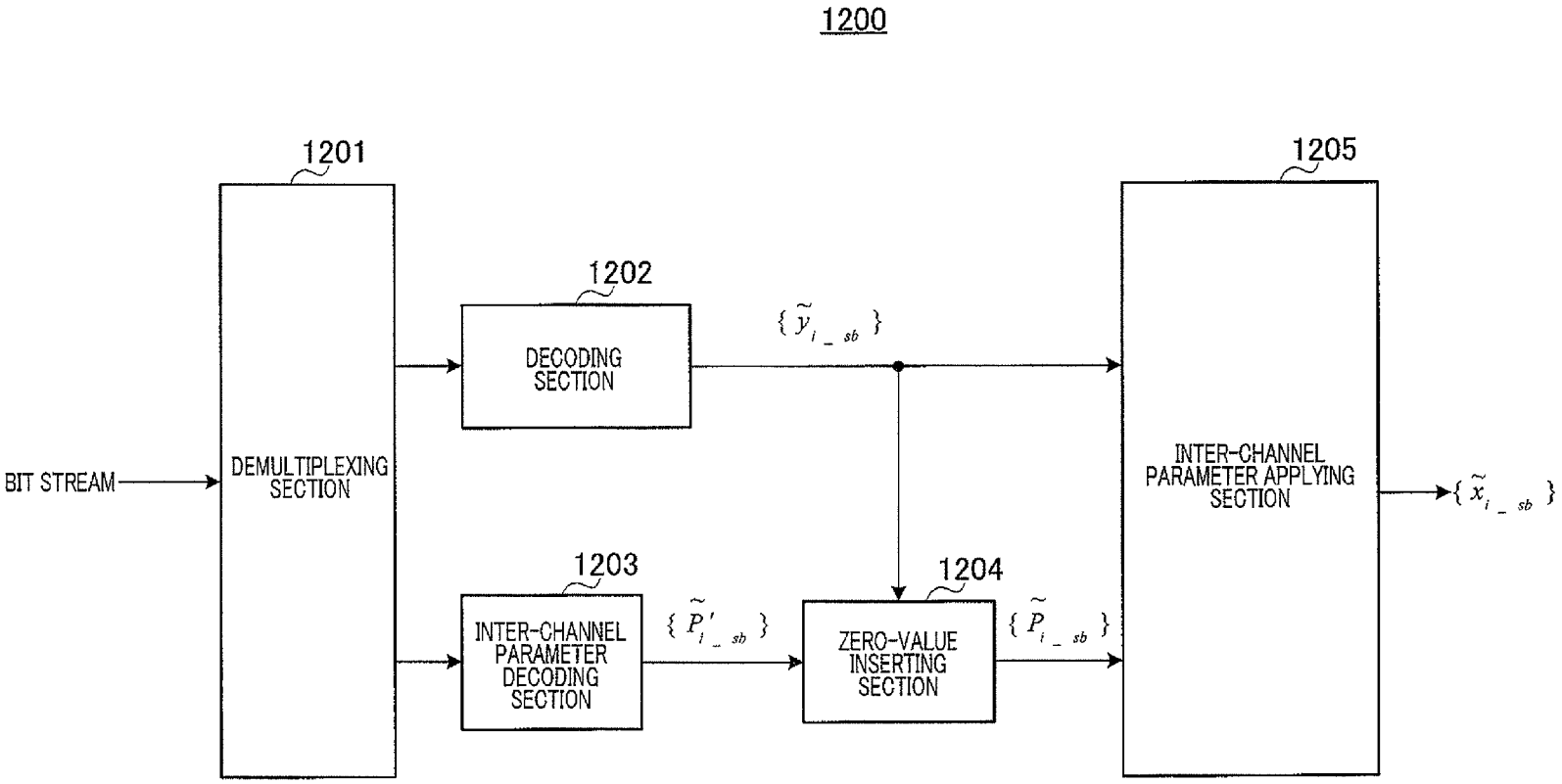
FIG. 12 illustrates a configuration of a speech decoding apparatus according to embodiment 2 of the present invention in multi-channel speech coding.

FIG. 12 illustrates a configuration of speech decoding apparatus 1200 according to the present embodiment.

In speech decoding apparatus 1200, demultiplexing section 1201 demultiplexes the bit stream.

Decoding section 1202 decodes coding parameters of $\{y_{i_sb}\}$, and generates transformed or down-mixed signals $\{y_{i_sb}\}$.

Decoding section 1203 (inter-channel parameter decoding section) decodes coding parameters of $\{P'_{i_sb}\}$, and generates decoded inter-channel parameters $\{P'_{i_sb}\}$.

Zero-value inserting section 1204 analyzes the decoded spectra of the transformed or down-mixed signals, selects the subband without an inter-channel parameter, and inserts a zero value in the subband so that inverse transformation or up-mixing can be performed smoothly.

By using spatial information represented by the decoded inter-channel parameters $\{P_{i_sb}\}$, inter-channel parameter applying section 1205 inversely transforms or up-mixes decoded signals $\{y_{i_sb}\}$ to generate $\{x_{i_sb}\}$.

The decoding processing according to the present embodiment will be described referring to FIG. 13.

Figure 13:
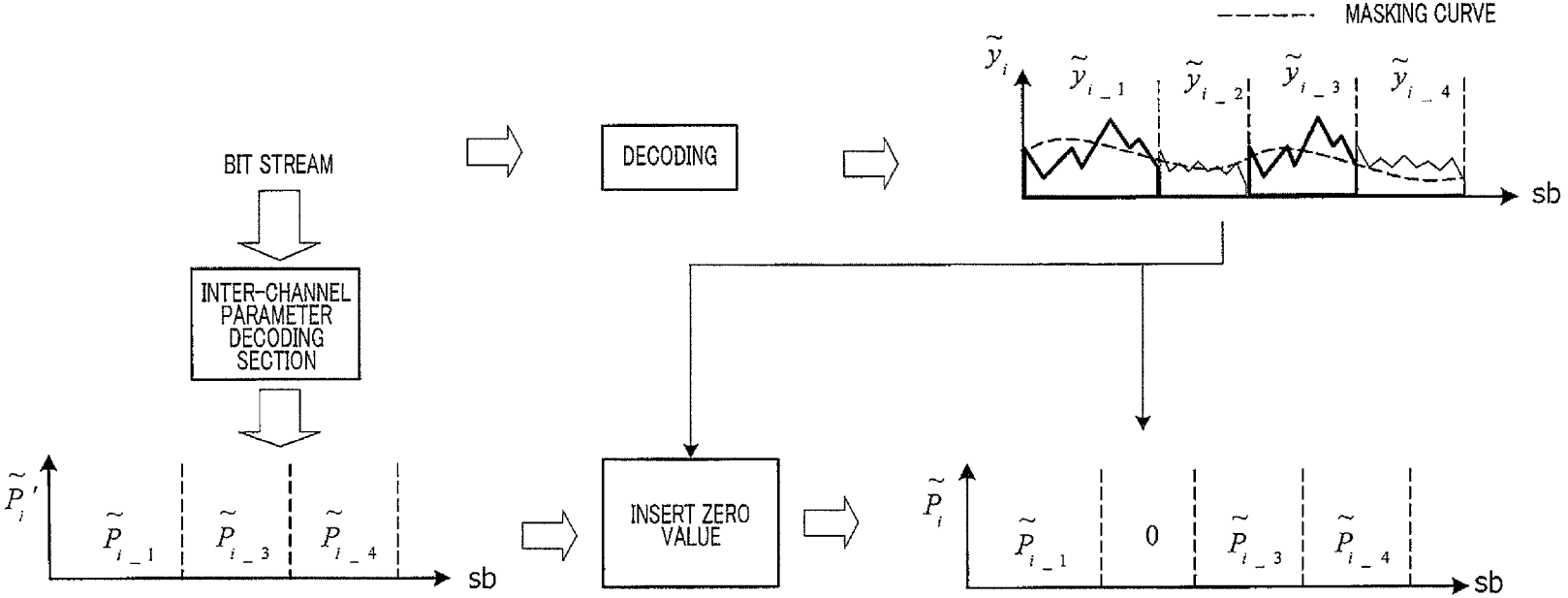
FIG. 13 illustrates decoding processing according to embodiment 2 of the present invention in multi-channel speech coding.

As illustrated in FIG. 13, analyzing the decoded spectra after generating the decoded spectra, shows that the decoded signal of the second subband is critically weak (in an extreme case, the decoded signal is 0). That is, the inter-channel parameter of the second subband is not encoded. Thus, only inter-channel parameters of other subbands are decoded. In order to perform the decoding processing smoothly, a zero value is inserted to the decoded inter-channel parameter of the second subband. The method of the decoding side to determine whether or not the inter-channel parameters are encoded is the same as the method of the coding side for the purpose of maintaining consistency with the coding side.

As described above, before encoding and transmitting inter-channel parameters, the present embodiment analyzes the signal characteristics per signal transformed in each subband, and checks whether or not it is necessary to transmit the inter-channel parameters. Then, the inter-channel parameter not necessary to be transmitted is selected and deleted from the coding targets.

Therefore, according to the present embodiment, by deleting unnecessary inter-channel parameters from the coding targets, it is possible to prevent encoding the unnecessary parameters and hence to improve a coding efficiency.

Also, according to the present invention, the redundant parameters are selected by a closed loop method. That is, by analyzing the coding quality of signals, the local decoding section in the coding side selects redundant parameters.

Thus, according to the present embodiment, the local decoding section can specify the subband including the redundant parameter (unimportant inter-channel parameter). Thus, the possibility of decreasing sound quality is avoided.

Also, according to the present invention, the decoding side selects a subband in which no inter-channel parameter exists, by decoding and analyzing the transformed or down-mixed signals. Therefore, a flag signal reporting to the decoding section that no inter-channel parameter exists in a specific subband is not required.

As mentioned above, according to the present embodiment, unnecessity of additional information to represent the flag signals can improve the coding efficiency.

Embodiment 3

The present embodiment will be described referring to FIG. 14 and FIG. 15. The meanings of signs in FIG. 14 and FIG. 15 are the same as those of embodiment 2.

In the present embodiment, the decoding side predicts the non-existent inter-channel parameter, from parameters of adjacent subbands, parameters of the former frame, or both of them. The predicted value is used in performing inverse transformation or up-mixing.

Figure 14:
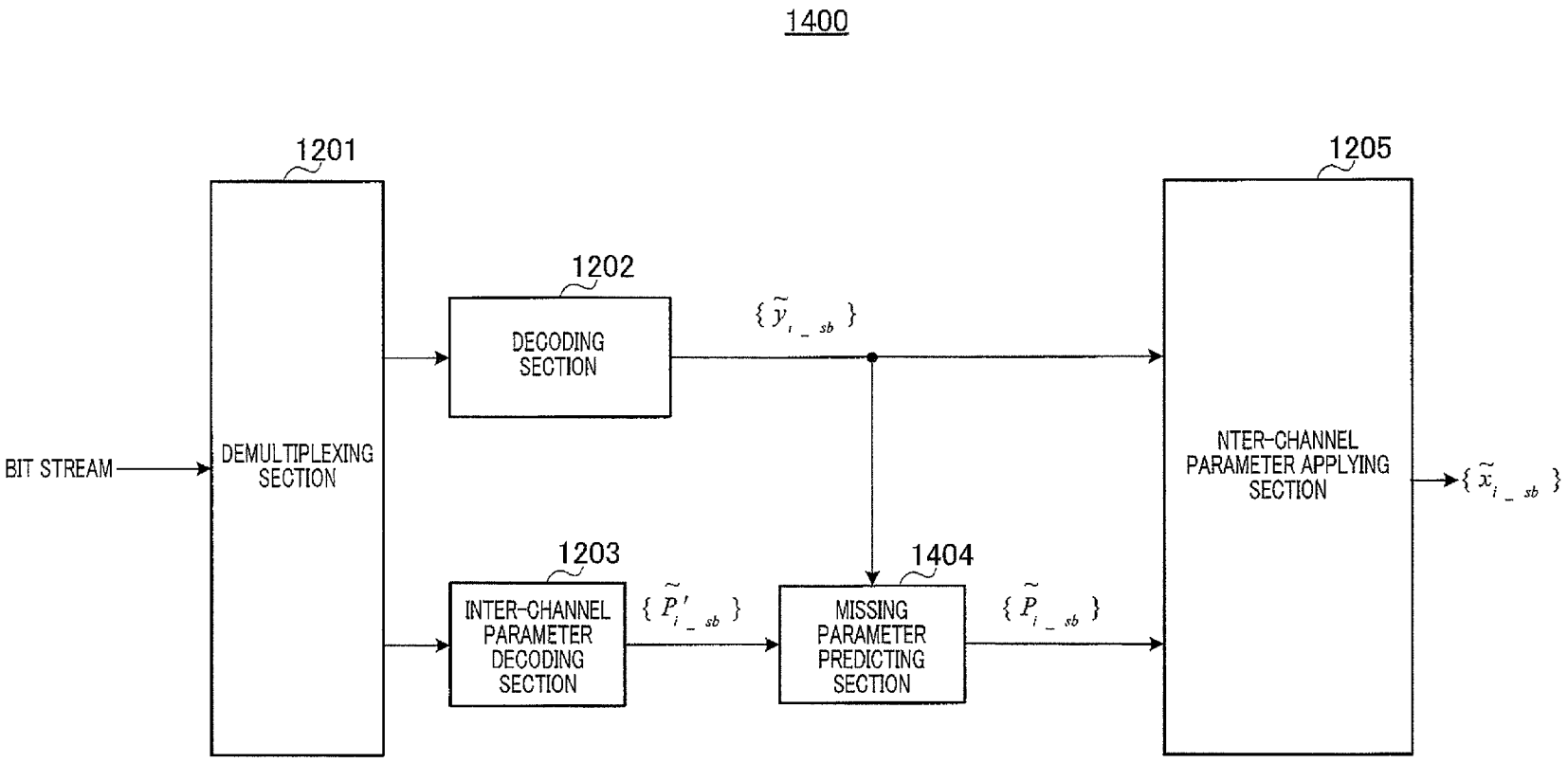
FIG. 14 illustrates a configuration of a speech decoding apparatus according to embodiment 3 of the present invention in multi-channel speech coding.
Figure 15:
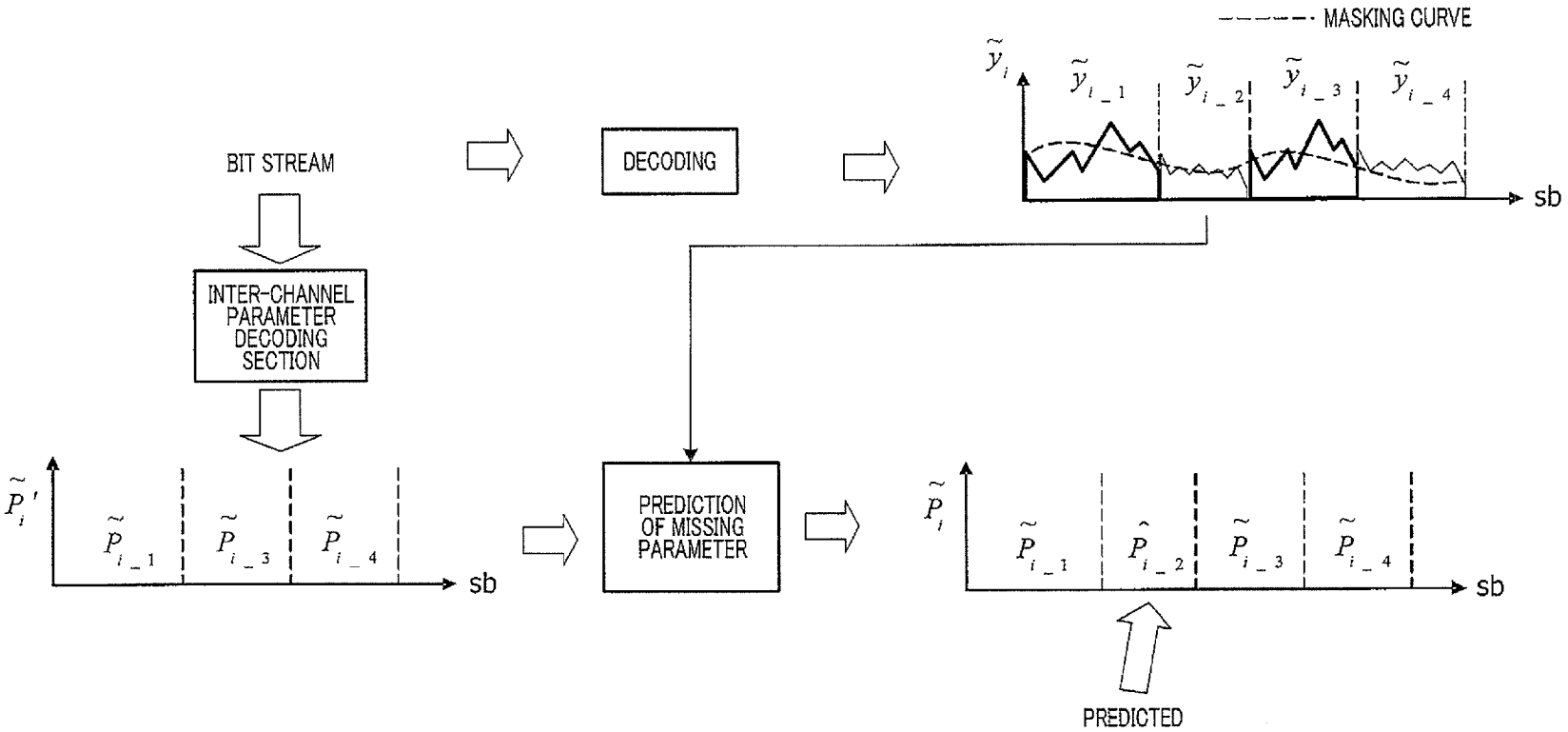
FIG. 15 illustrates decoding processing according to embodiment 3 of the present invention in multi-channel speech coding.

FIG. 14 illustrates a configuration of speech decoding apparatus 1400 according to the present embodiment. In FIG. 14, zero-value inserting section 1204 illustrated in FIG. 12 is replaced with missing parameter predicting section 1404. In FIG. 14, descriptions on the components as the same as those in FIG. 12 will be omitted.

In speech decoding apparatus 1400, missing parameter predicting section 1404 predicts the non-existent inter-channel parameter by using the parameters of the adjacent subbands or the parameters of the former frame without insertion of a zero value into the non-existent inter-channel parameter.

The decoding processing according to the present embodiment will be described referring to FIG. 15.

FIG. 15 illustrates an example of a case where, because of the absence of the inter-channel parameter in the second subband in the decoding side, the decoding side predicts this inter-channel parameter from the parameters of the adjacent subbands or the parameters of the former frame.

There are many other methods to predict non-existent inter-channel parameters.

For example, as the following equation, there is a method to interpolate the non-existent inter-channel parameter using the parameters of the adjacent subbands.

(Equation 6)

$$\tilde{P}_{i_2} = \frac{\tilde{P}_{i_1} + \tilde{P}_{i_3}}{2} \quad [6]$$

Also, as the following equation, there is a method to predict a non-existent inter-channel parameter using the parameters of the former frame. This method is effective when the spatial image is stable in a time domain.

(Equation 7)

$$\tilde{P}_{i_2} = \tilde{P}_{i_2_old} \quad [7]$$

As described above, according to the present embodiment, the decoding side predicts the non-existent inter-channel parameter from the parameters of the adjacent subbands, the parameters of the former frame, or both of them. The predicted value is used on performing inverse transformation or up-mixing.

By this means, it is possible to predict the non-existent inter-channel parameters to maintain spatial images.

Embodiment 4

The present embodiment will be described referring to FIG. 16 to FIG. 19. The meanings of signs in FIG. 16 to FIG. 19 are as follows.

$\{x_{i_sb}\}$: multi-channel signals divided into a plurality of subbands (which represents signals in a frequency domain, a time domain, or a hybrid domain where the frequency domain and the time domain are combined)

$\{y_{i_sb}\}$: down-mixed or transformed signals divided into a plurality of subbands (which are the signals in the same domain as $\{x_{i_sb}\}$)

$\{P_{i_sb}\}$: inter-channel parameters calculated every subband $\{x_{i_sb}\}$: decoded signals of $\{x_{i_sb}\}$ $\{y_{i_sb}\}$: decoded signals of $\{y_{i_sb}\}$ $\{P_{i_sb}\}$: decoded inter-channel parameters In the present invention, an open loop method selects redundant parameters. By analyzing the characteristics of the transformed or down-mixed original signal, the present embodiment selects the redundant inter-channel parameters and deletes the parameters from the coding targets.

Figure 16:
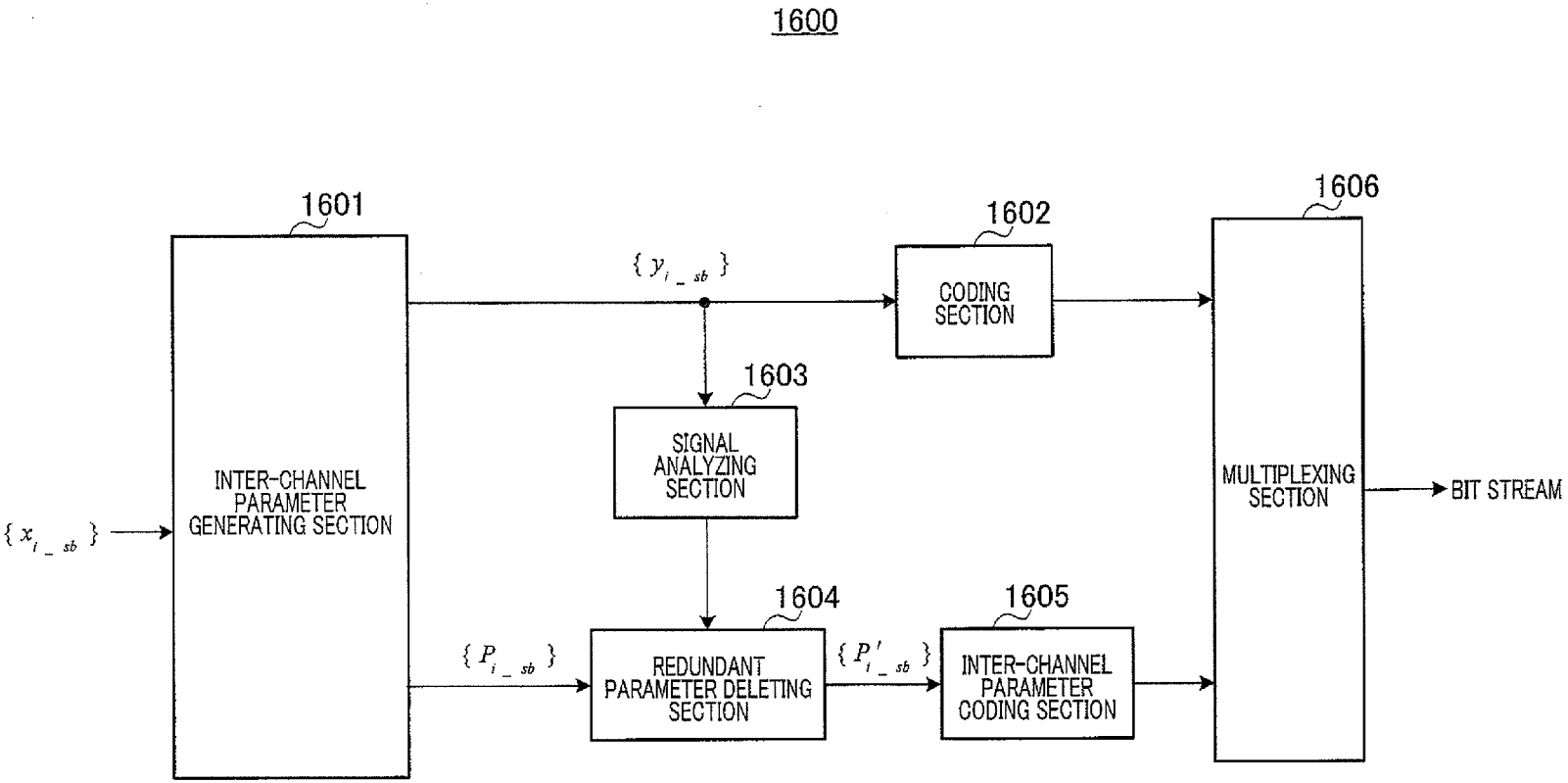
FIG. 16 illustrates a configuration of a speech coding apparatus according to embodiment 4 of the present invention in multi-channel speech coding.

FIG. 16 illustrates a configuration of speech coding apparatus 1600 according to the present embodiment.

In speech coding apparatus 1600, inter-channel parameter generating section 1601 transforms or down-mixes input signal $\{x_{i_sb}\}$ into $\{y_{i_sb}\}$ by BCC, PCA or the like. During the transforming and down-mixing processing, inter-channel parameter generating section 1601 also generates inter-channel parameter $\{P_{i_sb}\}$.

Coding section 1602 encodes the transformed or down-mixed signal $\{y_{i_sb}\}$.

Signal analyzing section 1603 selects the redundant parameters by analyzing the signal characteristics of the transformed or down-mixed signal $\{y_{i_sb}\}$.

Redundant parameter deleting section 1604 selects the redundant parameters and deletes the parameters from the coding targets.

Coding section 1605 (inter-channel parameter coding section) encodes remaining inter-channel parameters $\{P'_{i_sb}\}$ after deleting the redundant parameters.

Multiplexing section 1606 multiplexes coding parameters of $\{y_{i_sb}\}$ and coding parameters of $\{P'_{i_sb}\}$, generates and then transmits a bit stream to the decoding side.

The coding processing according to the present embodiment will be described referring to FIG. 17.

Figure 17:
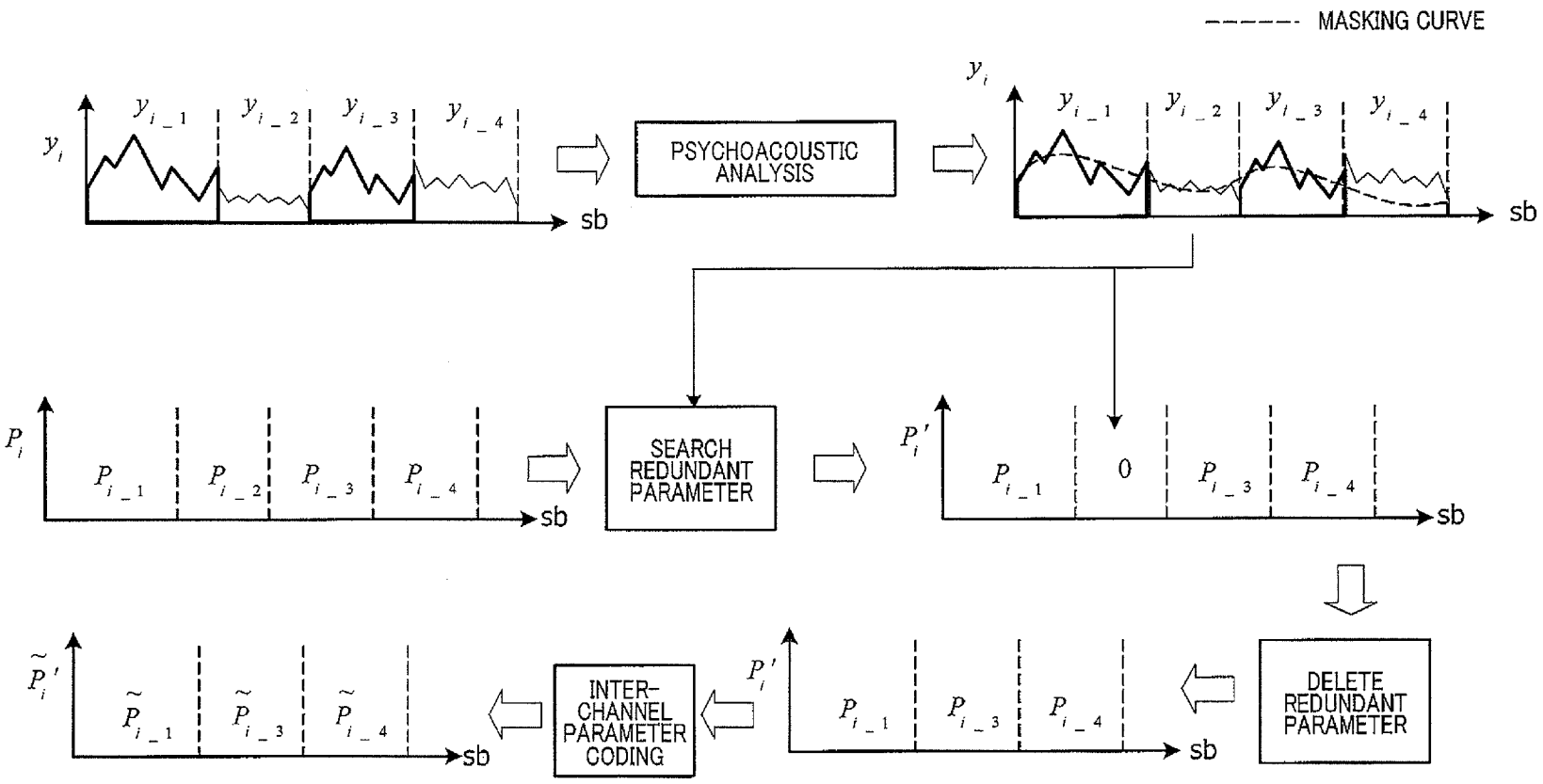
FIG. 17 illustrates coding processing according to embodiment 4 of the present invention in multi-channel speech coding.

As illustrated in FIG. 17, the characteristics of the transformed or down-mixed signals are analyzed by an energy analysis, a psychoacoustic analysis, a bit allocating analysis, or the like. The analysis shows that the transformed or down-mixed signal is critically weak, for example, in the second subband. In this case, there is no need to encode the inter-channel parameters of the second subband. Therefore, the inter-channel parameters of the second subband is regarded as the redundant parameters, and deleted from the coding targets before encoding.

There are many methods, such as the following two, to determine whether or not the subband signals are sufficiently weak. However, the present invention is not limited to the followings.

<Method 1> Case Where Signal Energy of Subband is Extremely Lower than Adjacent Subbands Every subband, this method calculates energy $\{E_{sb}\}$ and energy ratios of the subband to the adjacent subbands, and then compares the energy ratios with a certain predetermined value $E_{th}$ ($E_{th}<1$). When both energy ratios are smaller than $E_{th}$, the subband signal is regarded as weak. For example, two energy ratios $E_2/E_1$ and $E_2/E_3$ are calculated in the second subband. If $E_2/E_1<E_{th}$ and $E_2/E_3<E_{th}$ hold true, the signal of the second subband is regarded as weak in this case. In this case, the inter-channel parameter of the second subband is regarded as the redundant parameter.

<Method 2> Case Where Subband Signal is Close to or Lower than Masking Curve

Every subband, this method calculates energy $\{E_{sb}\}$ and masking curve level $\{M_{sb}\}$, and then compares the masking curve level with the subband energy. In this case, it is possible to define another threshold $M_{th}$ ($M_{th}>0$). When the subband energy is smaller than or close to a masking curve, that is, $E_{sb}<M_{sb}+M_{th}$ holds true, the subband energy is regarded as weak. For example, when subband energy $E_2$ is compared with masking curve level $M_2$ and thereby $E_2<M_2+M_{th}$ holds true, the signal of the second subband is regarded as weak. The inter-channel parameter in the second subband is regarded as the redundant parameter.

Figure 18:
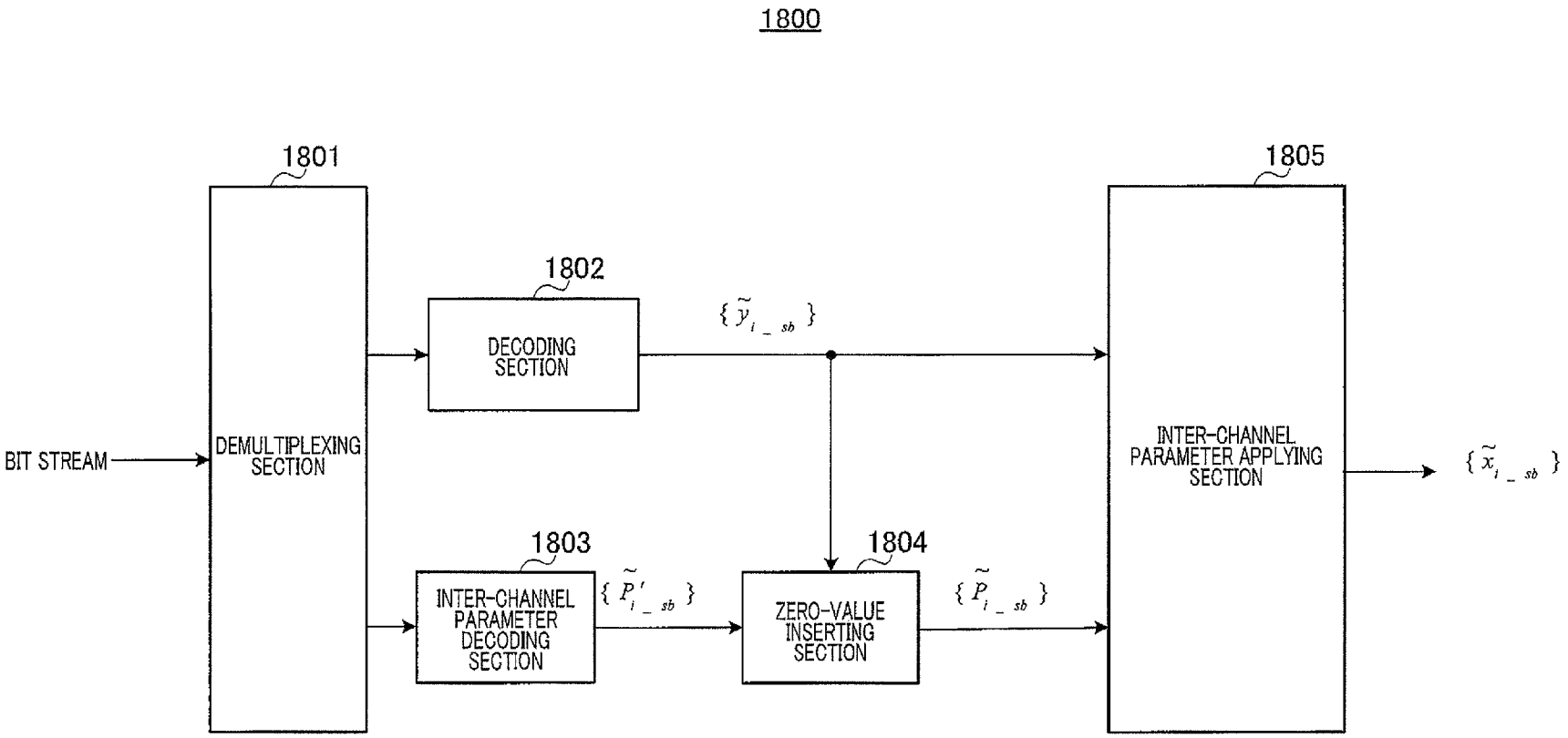
FIG. 18 illustrates a configuration of a speech decoding apparatus according to embodiment 4 of the present invention in multi-channel speech coding.

FIG. 18 illustrates a configuration of speech decoding apparatus 1800 according to the present embodiment.

In speech decoding apparatus 1800, demultiplexing section 1801 demultiplexes the bit stream.

Decoding section 1802 decodes coding parameters of $\{y_{i_sb}\}$, and generates the transformed or down-mixed signals $\{y_{i_sb}\}$.

Decoding section 1803 (inter-channel parameter decoding section) decodes coding parameters of $\{P'_{i_sb}\}$, and generates decoded inter-channel parameters $\{P'_{i_sb}\}$.

Zero-value inserting section 1804 analyzes the decoded spectrum of the transformed or down-mixed signal, selects the subband without an inter-channel parameter, and inserts a zero value in the subband so that inverse transformation or up-mixing can be performed smoothly.

By using spatial information represented by decoded inter-channel parameters $\{P_{i_sb}\}$, inter-channel parameter applying section 1805 inversely transforms or up-mixes the decoded signals $\{y_{i_sb}\}$ to generate $\{x_{i_sb}\}$.

The decoding processing according to the present embodiment will be described referring to FIG. 19.

Figure 19:
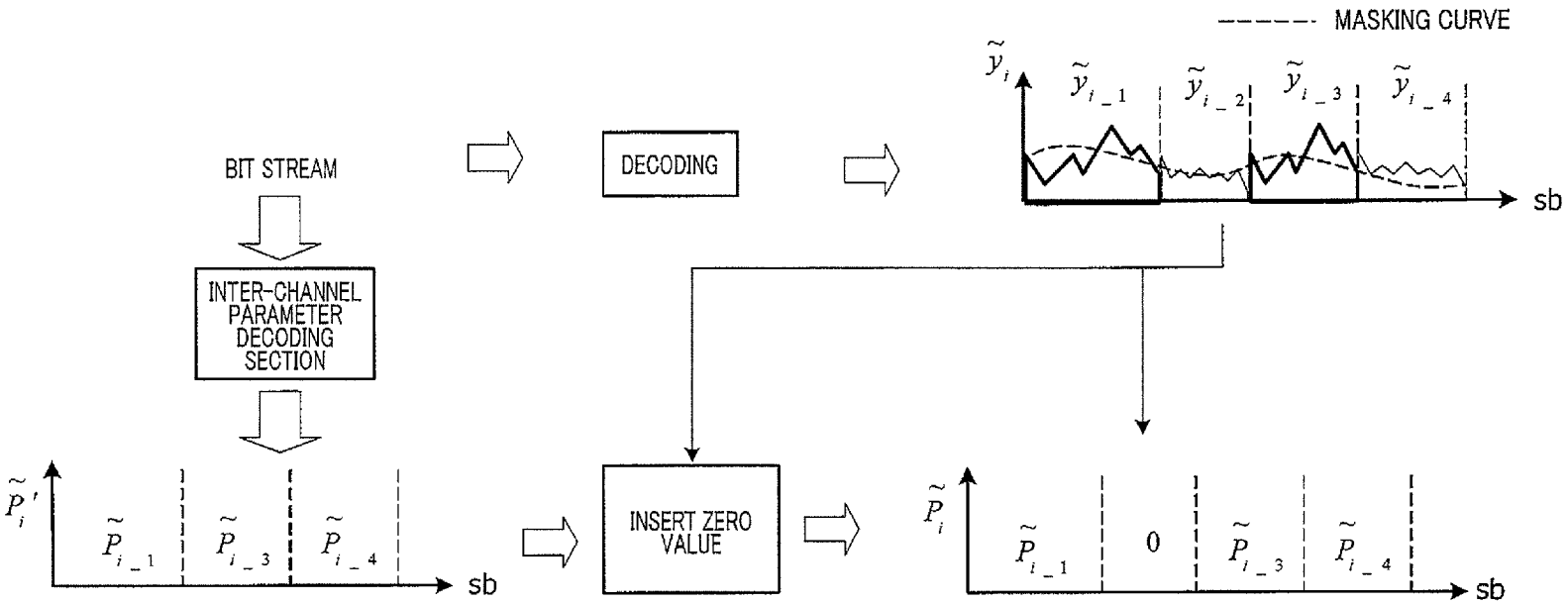
FIG. 19 illustrates decoding processing according to embodiment 4 of the present invention in multi-channel speech coding.

As illustrated in FIG. 19, analyzing the decoded spectra after generating the decoded spectra, shows that the decoded signal of the second subband is critically weak (in an extreme case, the decoded signal is 0). That is, the inter-channel parameter of the second subband is not encoded. Thus, only inter-channel parameters of other subbands are decoded. In order to perform the decoding processing smoothly, a zero value is inserted to the decoded inter-channel parameter of the second subband. The method of the decoding side to determine whether or not the inter-channel parameters are encoded is the same as the method of the coding side for the purpose of maintaining consistency with the coding side.

According to the present invention, the redundant parameters are selected by an open loop method. That is, an analysis of the characteristics of transformed or down-mixed original signals selects the redundant parameters.

Therefore, the present embodiment does not require a local decoding section. Thus, the present embodiment is useful in the condition incapable of using the local decoding section. Also, absence of the local decoding section can reduce the amount of calculations.

Embodiment 5

The present embodiment will be described referring to FIG. 20 to FIG. 23. The meanings of signs in FIG. 20 to FIG. 23 are as follows.

$\{x_{i_sb}\}$: multi-channel signals divided into a plurality of subbands (which represents signals in a frequency domain, a time domain, or a hybrid domain where the frequency domain and the time domain are combined)

$\{y_{i_sb}\}$: down-mixed or transformed signals divided into a plurality of subbands (which are the signals in the same domain as $\{x_{i_sb}\}$)

$\{P_{i_sb}\}$: inter-channel parameters calculated every subband $\{x_{i_sb}\}$: decoded signals of $\{x_{i_sb}\}$ $\{y_{i_sb}\}$: decoded signals of $\{y_{i_sb}\}$ $\{P_{i_sb}\}$: decoded inter-channel parameters The present embodiment deletes redundant parameters in scalable codec.

Figure 20:
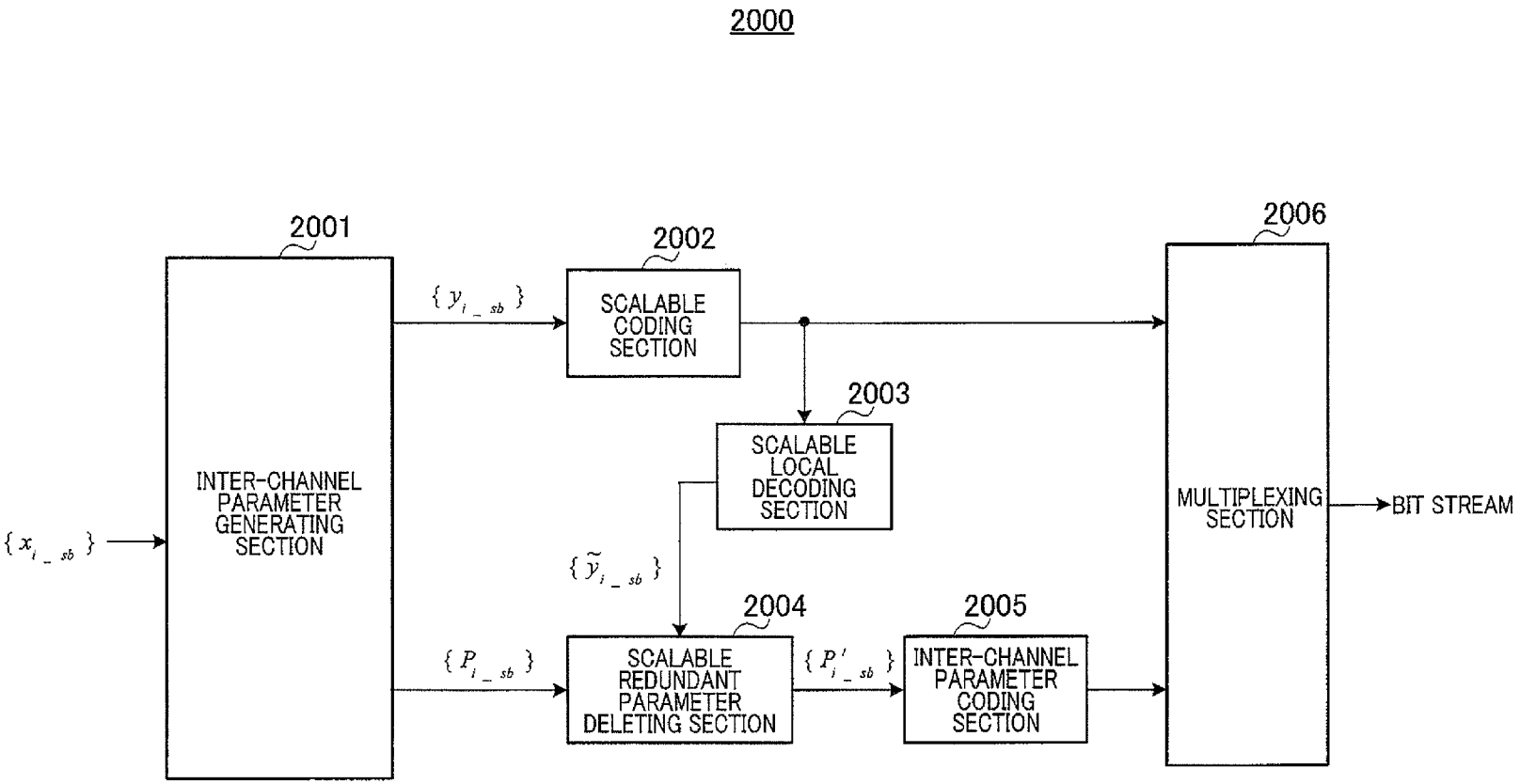
FIG. 20 illustrates a configuration of a speech coding apparatus according to embodiment 5 of the present invention in multi-channel speech coding.

FIG. 20 illustrates a configuration of speech coding apparatus 2000 according to the present embodiment.

In speech coding apparatus 2000, inter-channel parameter generating section 2001 transforms or down-mixes input signals $\{x_{i_sb}\}$ into $\{y_{i_sb}\}$ by BCC, PCA or the like. During transforming and down-mixing processing, inter-channel parameter generating section 2001 also generates inter-channel parameters $\{P_{i_sb}\}$.

Scalable coding section 2002 encodes the transformed or down-mixed signals $\{y_{i_sb}\}$.

Scalable local decoding section 2003 generates decoded signals of layers, such that the coding side can identify coding quality of the transformed or down-mixed signals.

By analyzing the coding quality of the transformed or down-mixed signal, scalable redundant parameter deleting section 2004 selects redundant parameters and deletes these parameters from coding targets.

Coding section 2005 (inter-channel parameter coding section) encodes the remaining inter-channel parameters $\{P'_{i_sb}\}$ after deleting the redundant parameters.

Multiplexing section 2006 multiplexes the coding parameters of $\{y_{i_sb}\}$ and coding parameters of $\{P'_{i_sb}\}$, generates and then transmits a bit stream to the decoding side.

The coding processing according to the present embodiment will be described referring to FIG. 21.

Figure 21:
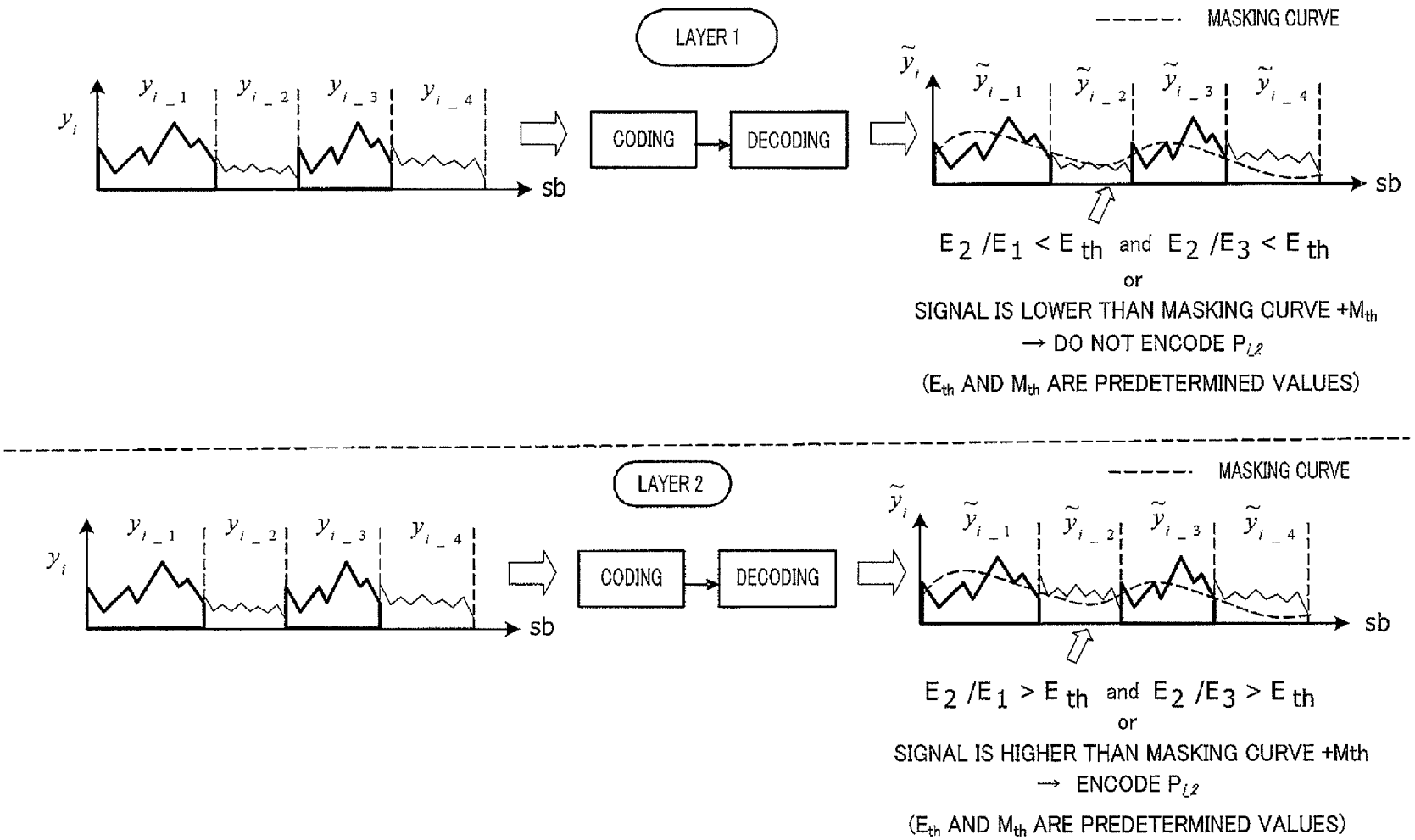
FIG. 21 illustrates coding processing according to embodiment 5 of the present invention in multi-channel speech coding.

As illustrated in FIG. 21, spectra of the transformed or down-mixed signals are encoded and decoded. Analyzing the decoded spectra after generating the decoded spectra, shows that since the transformed or down-mixed signals, for example, in the second subband in layer 1 of FIG. 21, are critically weak (in an extreme case, the second subband is not encoded at all), the decoded signal is 0. In this case, in layer 1, there is no need to encode the inter-channel parameter of the second subband. Therefore, in layer 1, the inter-channel parameter of the second subband is regarded as the redundant parameter, and deletes this parameter from the coding targets before encoding.

On the other hand, in layer 2, the decoded signal of the second subband is not weak, and hence it is necessary to encode the inter-channel parameter in order to prevent possible deterioration of sound quality. Therefore, it is layer 2 that firstly encodes the inter-channel parameter of the second subband.

There are many methods, such as the following two, to determine whether or not the subband signal is extremely weak. However, the present invention is not limited to the followings.

<Method 1> Case Where Signal Energy of Subband is Extremely Lower than Adjacent Subbands Every subband, this method calculates energy $\{E_{sb}\}$ and energy ratios of the subband to the adjacent subbands, and then compares the energy ratios with a certain predetermined value $E_{th}$ ($E_{th}<1$). When both energy ratios are smaller than $E_{th}$, the subband signal is regarded as weak. For example, two energy ratios $E_2/E_1$ and $E_2/E_3$ are calculated in the second subband. If $E_2/E_1<E_{th}$ and $E_2/E_3<E_{th}$ hold true, the signal of the second subband is regarded as weak. The inter-channel parameter of the second subband is regarded as the redundant parameter.

<Method 2> Case Where Subband Signal is Close to or Lower than Masking Curve

Every subband, this method calculates energy $\{E_{sb}\}$ and masking curve level $\{M_{sb}\}$, and then compares the masking curve level with the subband energy. In this case, it is possible to define another threshold $M_{th}$ ($M_{th}>0$) When the subband energy is smaller than or close to a masking curve, that is, when $E_{sb}<M_{sb}+M_{th}$ holds true, the subband energy is regarded as weak. For example, when subband energy $E_2$ is compared with masking curve level $M_2$ and thereby $E_2<M_2+M_{th}$ holds true, the signal of the second subband is regarded as weak. The inter-channel parameter in this second subband is regarded as the redundant parameter.

Figure 22:
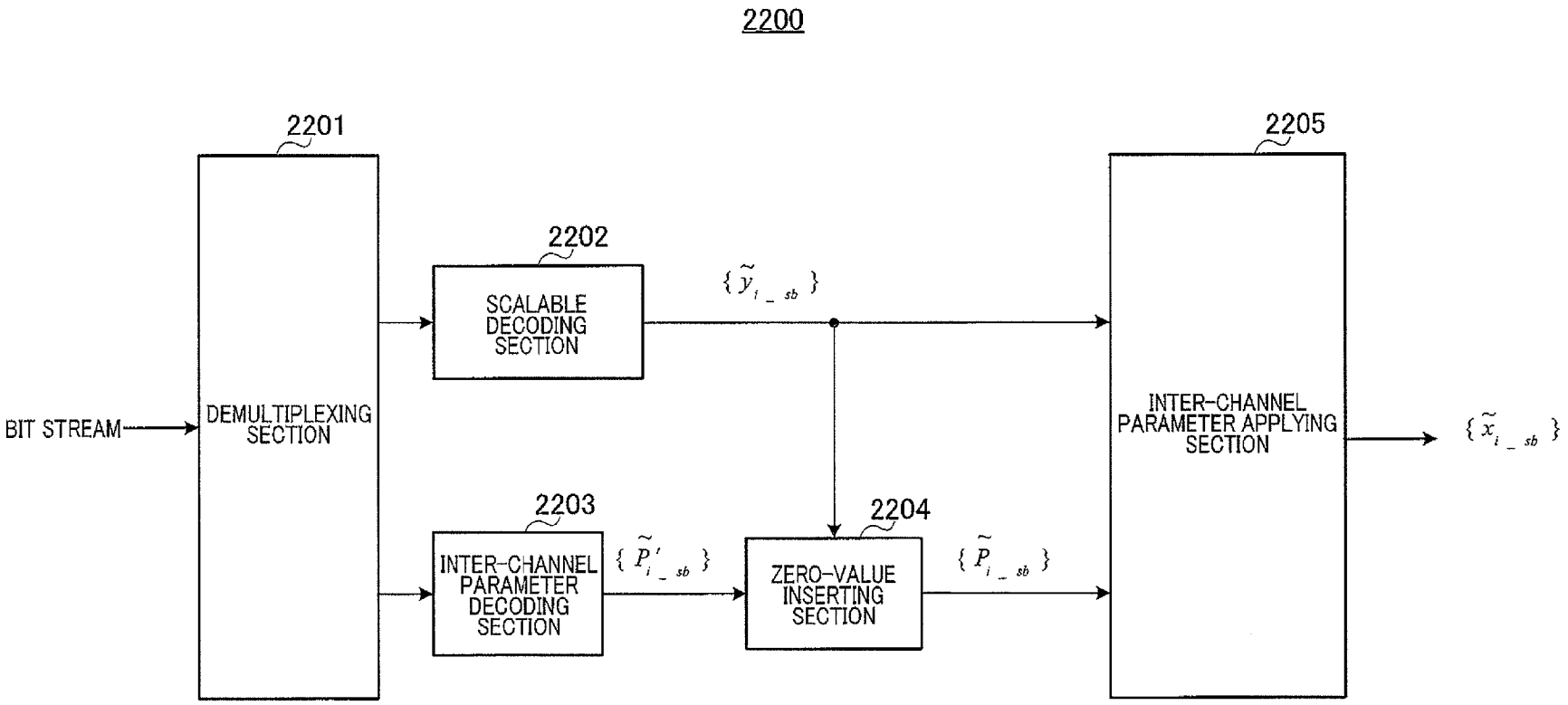
FIG. 22 illustrates a configuration of a speech decoding apparatus according to embodiment 5 of the present invention in multi-channel speech coding.

FIG. 22 illustrates a configuration of speech decoding apparatus 2200 according to the present embodiment.

In speech decoding apparatus 2200, demultiplexing section 2201 demultiplexes the bit stream in each layer.

Scalable decoding section 2202 decodes coding parameters of $\{y_{i_sb}\}$, and generates transformed or down-mixed signals $\{y_{i_sb}\}$.

Decoding section 2203 (inter-channel parameter decoding section) decodes coding parameters of $\{P'_{i_sb}\}$, and generates decoded inter-channel parameters $\{P'_{i_sb}\}$.

In each layer, zero-value inserting section 2204 analyzes the decoded spectrum of the transformed or down-mixed signal, selects the subband without an inter-channel parameter, and inserts a zero value in the subband so that inverse transformation or up-mixing can be performed smoothly.

By using spatial information represented by inter-channel parameters $\{P_{i_sb}\}$, inter-channel parameter applying section 2205 inversely transforms or up-mixes decoded signals $\{y_{i_sb}\}$ to generate $\{x_{i_sb}\}$.

The decoding processing according to the present embodiment will be described referring to FIG. 23.

Figure 23:
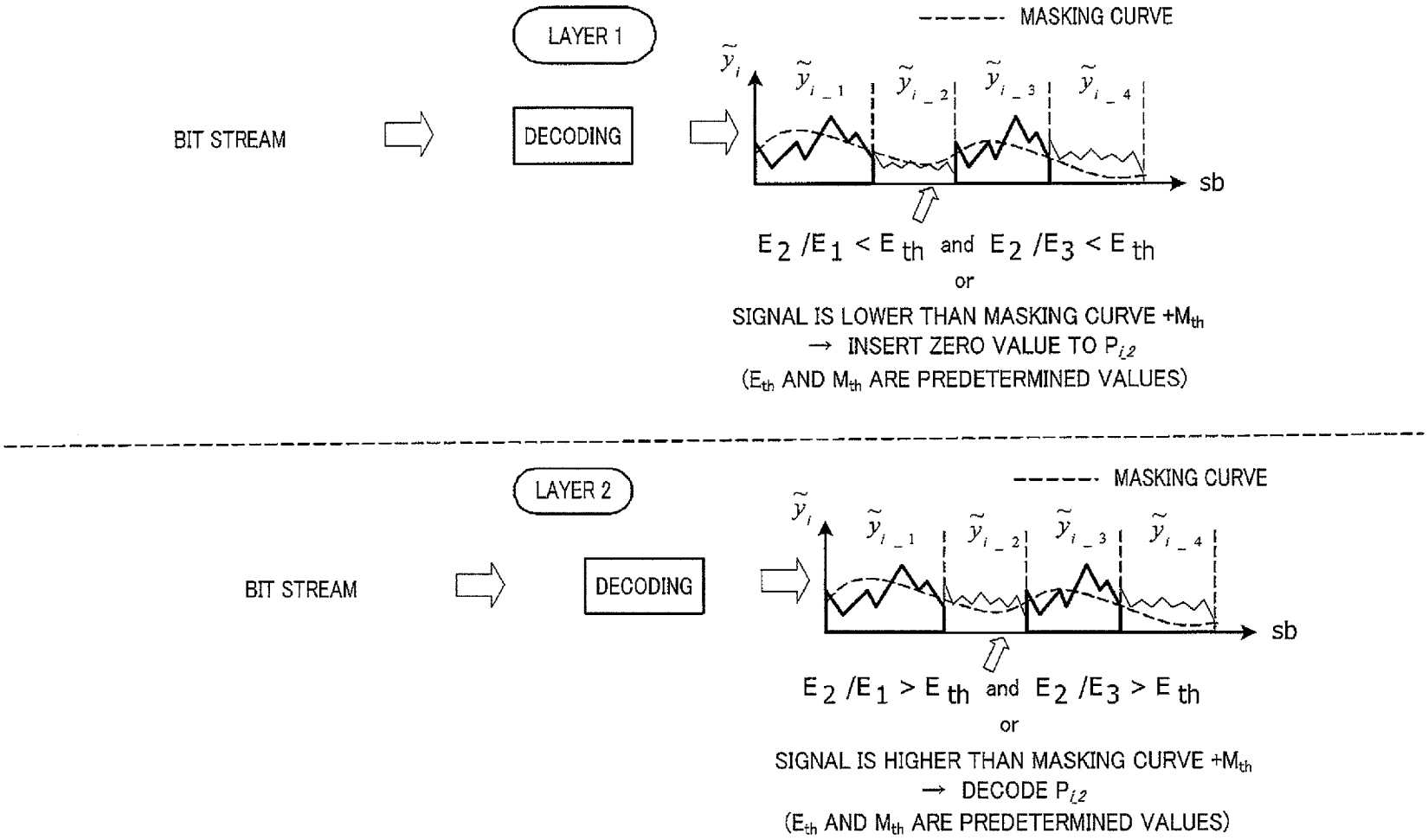
FIG. 23 illustrates decoding processing according to embodiment 5 of the present invention in multi-channel speech coding.

As illustrated in FIG. 23, analyzing the decoded spectra after generating the decoded spectra, shows that, in layer 1, the decoded signal of the second subband is critically weak (in an extreme case, the decoded signal is 0). That is, the inter-channel parameter of the second subband is not encoded. Thus, only inter-channel parameters of other subbands are decoded. In order to perform the decoding processing smoothly, a zero value is inserted to the decoded inter-channel parameter of the second subband.

On the other hand, since the decoded signal of the second subband is not weak in layer 2, it is necessary to encode the inter-channel parameter of the second subband.

The method of the decoding side to determine whether or not the inter-channel parameters are encoded is the same as the method of the coding side for the purpose of maintaining consistency with the coding side.

As described above, before encoding inter-channel parameters and transmitting the result, in each layer of scalable coding, the present embodiment analyzes the characteristics of transformed or down-mixed signals every subband and checks whether or not it is necessary to transmit the inter-channel parameters. Then, the inter-channel parameter not necessary to be transmitted is selected and deleted from the coding targets. Meanwhile, in the case of the layer requiring the inter-channel parameter so as to generate input signals, the inter-channel parameter is transmitted.

Therefore, the present invention can realize precise bit allocation so as to transmit the inter-channel parameter only for the layer requiring the inter-channel parameter.

The disclosure of Japanese Patent Application No. 2009-298321, filed on Dec. 28, 2009, including the specification, drawings and abstract, is incorporated herein by reference in its entirety.

INDUSTRIAL APPLICABILITY

The present invention is suitable for a communication apparatus performing speech coding, a communication apparatus performing speech decoding, and particularly a wireless communication apparatus.

REFERENCE SIGNS LIST

600 Speech coding apparatus
603 Local monaural decoding section
604 Redundant parameter deleting section
800 Speech decoding apparatus
804 Zero-value inserting section

The invention claimed is:

1. A speech coding apparatus, comprising:

a transforming section, using a communication apparatus, that transforms input speech signals of a plurality of channels into principal-component signals, and calculates an inter-channel parameter every subband, the inter-channel parameter representing a relationship of inter-channel signals;

a first coding section, using the communication apparatus, that encodes the principal-component signal to obtain a coded principal-component signal;

a decoding section, using the communication apparatus, that decodes the coded principal-component signal to obtain a decoded principal-component signal;

a deleting section, using the communication apparatus, that deletes a redundant parameter from the inter-channel parameter of the subband using energy of the decoded principal-component signal of the subband; and a second coding section, using the communication apparatus, that encodes the inter-channel parameter from which the redundant parameter is deleted.

2. The speech coding apparatus according to claim 1, wherein:

the transforming section transforms the input speech signal into the principal-component signal by a principal component analysis; and the inter-channel parameter is a rotation angle.

3. The speech coding apparatus according to claim 1, wherein the deleting section compares a threshold with an energy ratio of each subband to an adjacent subband and deletes the inter-channel parameter if the energy ratio is smaller than the threshold.

4. The speech coding apparatus according to claim 1, wherein the deleting section compares energy of each subband with the level of a masking curve, and deletes the inter-channel parameter if the energy is close to or lower than the masking curve.

5. A speech coding method, comprising:

transforming, using a communication apparatus, input speech signals of a plurality of channels into principal-component signals, and calculating an inter-channel parameter every subband, the inter-channel parameter representing a relationship of inter-channel signals;

encoding, using the communication apparatus, the principal-component signal to obtain a coded principal-component signal;

decoding, using the communication apparatus, the coded principal-component signal to obtain a decoded principal-component signal;

deleting, using the communication apparatus, a redundant parameter from the inter-channel parameter of the subband using energy of the decoded principal-component signal of the subband; and encoding, using the communication apparatus, the inter-channel parameter from which the redundant parameter is deleted.

* * * * *